US007690855B2

(12) United States Patent
Haneda et al.

(10) Patent No.: US 7,690,855 B2
(45) Date of Patent: Apr. 6, 2010

(54) BINDING TOOL FOR DOCUMENTS OR THE LIKE

(75) Inventors: Tatsuya Haneda, Tokyo (JP); Kouichi Tanimoto, Tokyo (JP)

(73) Assignee: King Jim Co., Ltd., Tokyo (JP)

( * ) Notice: Subject to any disclaimer, the term of this patent is extended or adjusted under 35 U.S.C. 154(b) by 0 days.

(21) Appl. No.: 11/636,058

(22) Filed: Dec. 8, 2006

(65) Prior Publication Data

US 2007/0134053 A1 Jun. 14, 2007

(30) Foreign Application Priority Data

Dec. 9, 2005 (JP) ..... 2005-356797

(51) Int. Cl.

| | |
|---|---|
| ***B42F 13/20*** | (2006.01) |
| ***B42F 3/00*** | (2006.01) |
| ***B42F 13/40*** | (2006.01) |
| ***B42F 13/00*** | (2006.01) |
| ***B42F 13/12*** | (2006.01) |

(52) U.S. Cl. ..... 402/31; 402/35; 402/38; 402/41; 402/5; 402/26; 402/40; 402/33; 402/80 R

(58) Field of Classification Search ..... 281/21.1; 402/19, 20, 31, 35, 37, 38, 39, 41, 60, 70, 402/73, 500, 502; 412/38, 39, 40
See application file for complete search history.

(56) References Cited

U.S. PATENT DOCUMENTS

| | | | | |
|---|---|---|---|---|
| 2,789,561 | A * | 4/1957 | Hammerschlag et al. | 402/35 |
| 3,248,750 | A * | 5/1966 | Black | 16/419 |
| 4,830,528 | A * | 5/1989 | Handler | 402/34 |
| 5,209,593 | A * | 5/1993 | Ros | 402/77 |
| 5,222,825 | A * | 6/1993 | Wyant | 402/76 |
| 6,276,862 | B1 * | 8/2001 | Snyder et al. | 402/40 |
| 6,637,968 | B2 * | 10/2003 | Ko | 402/41 |
| 2003/0044221 | A1 * | 3/2003 | To et al. | 402/41 |
| 2003/0113156 | A1 * | 6/2003 | To | 402/31 |

FOREIGN PATENT DOCUMENTS

| | | | |
|---|---|---|---|
| GB | 952536 | A | 3/1964 |
| GB | 2387815 | A | 10/2003 |
| JP | S57-24077 | | 2/1982 |
| JP | S57-24077 | U | 2/1982 |
| WO | WO 2005/100044 | | 10/2005 |

OTHER PUBLICATIONS

Singapore Search and Examination Report for Appl. No. 200608546-8, dated Jun. 3, 2008, Danish Patent and Trademark Office.

* cited by examiner

*Primary Examiner*—Dana Ross
*Assistant Examiner*—Justin V Lewis
(74) *Attorney, Agent, or Firm*—Alston & Bird LLP

(57) ABSTRACT

A binding tool for documents or the like is provided which is capable of suppressing the height of protruded portions from a surface of a base portion thereby to expand a space thereabove, and which is also easy to manufacture and assemble. The binding tool includes a base portion (2) formed of a metal plate, rings (3) that are each mounted on the base portion so as to be selectively changed into a closed ring posture to bind documents or the like and an opened ring posture to open a part of a closed ring for insertion of the documents or the like, and a switching mechanism (5) that is mounted on the base portion and includes a switching lever (4) for switching the rings between the closed ring posture and the opened ring posture. The switching lever has a base end (41) and a free end (42), and a cam member (6) is provided on the base end of the switching member for adjusting the degree of opening/closing of each of the rings according to a rotated position of the free end. The cam member has a cam main body (61) and camshafts (62) that protrude from the cam main body, and bearing portions (25) are formed in the base portion. The bearing portions are each formed of an inner surface of a curved portion where a part of the base portion is curved to a front surface side thereof.

9 Claims, 29 Drawing Sheets

BINDING TOOL FOR DOCUMENTS OR THE LIKE

BACKGROUND OF THE INVENTION

1. Field of the Invention

The present invention relates to a technology for binding tools that serve to open and close rings, which are formed of ring members so as to be able to open and close, by means of a switching lever for filing or binding documents or the like.

2. Description of the Related Art

There have hitherto been widely known lever arch type binding tools which have a plurality of ring members fixedly secured to an inner surface of a cover body of a binder or the like in such a manner that the ring members can be opened by an operation of a lever.

As such a lever arch type binding tool, there is one described, for example, in a first patent document (Japanese utility model application laid-open No. S57-24077). The binding tool described in this document is provided with a strip-like base portion formed of a metal plate, two rings that are each formed of a plurality of ring members mounted on the base portion, and a switching mechanism with an operation lever that serves to change each ring to toggle between a closed ring posture and an opened ring posture. Those ones among the ring members constituting the two rings which are arranged at one side are constructed so as to be rotatable relative to the base portion in such a manner that the rings can be opened and closed by an operation of depressing the operation lever.

In the binding tool as described in the first patent document, in which the ring members at one side are constructed to be rotatable with respect to the base portion, the degree of opening of each ring is small and a portion thereof to be opened is limited to one side, and the operation lever protrudes in the vicinity of the rings in their open state, so operation efficiency upon binding or unbinding (taking out) documents or the like is poor.

In addition, in such a lever arch type binding tool, the switching mechanism is large in size and is located in a central portion between the two rings, and the lever extending therefrom protrudes in the vicinity of the rings in their open state, so the switching mechanism with the lever not only hinders the operation of binding or taking out the documents, etc., but also makes it difficult to remove or insert a lot of documents at a time.

In view of the above, the applicant for the present invention has already proposed a lever operated type binding tool for documents or the like, as described in a second patent document (PCT/JP2004/4912), which is constructed such that when two rings mounted on a base portion are in their opened ring postures, a switching lever can pass through an opened portion of each ring. In this binding tool, even when the rings are in their opened postures, it is possible to make a free end of said switching lever pass toward the outside of the rings thereby to put it into a shunt state. Accordingly, by preventing the switching lever from coming to a location at which the switching lever becomes a hindrance in the operation of taking out and putting in documents or the like, too, it is possible to improve workability or operation efficiency upon replacement of documents or the like.

In the binding tool described in the second patent document, bearing portions for a cam member, which lie at a base end of the switching lever, are formed in a cover portion that rises from the base portion. The bearing portions are constructed such that a pair of upright segments in spaced-apart opposition to each other rise upward from the center of the cover portion with a shaft pin, which serves as the center of rotation of the cam member, being arranged between the opposite upright segments. Therefore, a slightly large occupation space is needed in the center of the cover portion, and hence there has accordingly been a constraint in reducing the diameter of the rings. For example, in case of the ring diameter of about 32 mm or more, the function of the binding tool can be exhibited to a satisfactory extent, but with the ring diameter of less than 33 mm, the protruded portions including both the upright segments, etc., may sometimes hinder the operation of taking out or putting in documents or papers depending upon the kinds or types thereof.

In addition, since the cover portion is curved after rising from the opposite sides of the base portion and then further bent to rise vertically in the center thereof, there has been a problem that it is necessary to form curved portions at two locations until the upright segments are reached, thus making it difficult to enhance processing or working accuracy. The reduction in the processing or working accuracy results in instability of the position of the cam member, so it becomes impossible to make the cam member operate with high precision, and the function of the switching mechanism including the cam member will accordingly be reduced.

SUMMARY OF THE INVENTION

Accordingly, the object of the present invention is to provide a binding tool for documents or the like which, by considering the shape of a base member and the structure of bearing portions of a cam member, is capable of suppressing the height of protruded portions from a surface of a base portion so as to expand a space thereabove, and which is also easy to manufacture and assemble.

In order to achieve the above-mentioned object, the present invention adopted the following solutions.

A binding tool for documents or the like according to the present invention comprises:

a base portion that is formed of a metal plate;

rings that are each mounted on said base portion so as to be selectively changed into a closed ring posture to bind documents or the like and an opened ring posture to open part of a closed ring for insertion of the documents or the like; and a switching mechanism that is mounted on said base portion and includes a switching lever for switching said rings between said closed ring posture and said opened ring posture.

Said switching lever has a base end and a free end, and a cam member is provided on said base end of said switching member for adjusting the degree of opening/closing of each of said individual rings according to a rotated position of said free end of said switching lever.

Said cam member has a cam main body and camshafts that protrude from said cam main body.

Said base portion is formed with bearing portions for said camshafts, and said bearing portions are each formed of an inner surface of a curved portion where a part of said base portion is curved to a front surface side thereof.

According to the present invention, since the bearing portions for the camshafts are each formed of an inner surface of a curved portion where a part of the base portion is curved to a front surface side thereof, the center of each camshaft can be arranged in the vicinity of the base portion or therebeneath, and the thickness of the bearing portions with which the camshafts are covered becomes about the thickness of the metal plate that forms the base portion. Accordingly, the height of the bearing portions that protrude to above the front surface of the base portion can be lowered or decreased. As a result, it is possible to suppress the height of the protruded portions from the surface of the base portion, whereby a space above the surface of the base portion can be expanded or increased.

In the present invention, it is preferred that said base portion have a base main body and side piece portions at opposite sides thereof, which are formed by processing a metal plate in such a manner that said base main body forms the front surface of said base portion, and said side piece portions are bent in such a form as to incline toward a rear surface side of said base main body so as to form side surfaces of said base portion, and that said bearing portions for said camshafts be formed on said base main body. With such a construction, the bearing portions can be formed with the base main body being made as a reference, so the processing or working accuracy thereof can be improved to a great extent in comparison with the formation of a conventional two-stepped curved portion for example. Further, the bearing portions are directly formed on the base main body, so it is possible to eliminate easily deformable portions of the metal plate such as turn-back curved portions. As a result, the initial set position of the cam member can be stabilized.

In the present invention, it is preferred that said bearing portions be substantially semicircular in cross section, with an opened portion of the semicircular shape being directed to a rear surface side of the base main body. Thus, in case where the bearing portions are formed into a semicircular shape in cross section, the bearing portions that protrude above the surface of the base main body can be made to have an amount of protrusion equal to about half of the diameter of the camshafts added by the thickness of the metal plate of the bearing portions. As a result, the height of projection of the bearing portions and the cam member can be further suppressed.

In the present invention, it is preferred that the bearing portions of said base main body have surfaces formed into sloped surfaces that incline downwardly toward the side piece portions, respectively, of the base portion. With such formation of the sloped surfaces, it is possible to smoothly guide the end edges of the documents or the like to be bound to the rings so as to prevent them from being caught by the raised bearing portions due to their contact therewith. Accordingly, workability or operation efficiency in binding (filing) or taking out documents or the like can be improved even if the diameter of the rings is reduced.

In the present invention, it is preferred that said cam main body and said camshafts of said cam member be formed of synthetic resin in a mutually integrated manner. By so doing, the number of component parts required can be decreased, as compared with the case where the camshafts are formed of separate members such as shaft pins. In addition, a step of inserting the shaft pins can be eliminated upon assembly, so processing and assembling can accordingly be facilitated.

In the present invention, it is preferred that said cam main body have contact portions formed on its opposite side surfaces in parallel to the outer peripheries of the camshafts and in contact with the surfaces of said bearing portions, respectively. By so doing, the contact portions can serve the function of keeping the camshafts at fixed positions so as to prevent the camshafts of the cam member from being downwardly displaced (lowered) from the bearing portions. Thus, the cam member can be made to operate with a high degree of precision.

In the present invention, it is preferred that said rings be arranged at intervals in a longitudinal direction of the base portion, and said switching mechanism be set in such a manner that when the rings are each in their opened ring posture, the switching lever is able to pass an opened portion of each ring. With such a construction, even when the rings are each in their opened posture, it is possible to make the free end of the switching lever pass toward the outside of the rings thereby to put it into a shunt state. Accordingly, by preventing the switching lever from coming to a location at which the switching lever becomes a hindrance in the operation of taking out and putting in documents or the like, too, the documents or the like can be replaced in either of the right and left rings, thus making it possible to improve the workability or operation efficiency to a great extent.

In the present invention, the binding tool may be constructed as follows. That is, each of said rings has a first ring member and a second ring member which can take a closed ring posture with their tip ends being in contact with each other and an opened ring posture with their tip ends being apart from each other, and said switching mechanism has two support members that are arranged side by side in the base portion, and are each tiltable to a side orthogonal to the longitudinal direction of the base portion. Said first ring member is supported by one of the support members, whereas said second ring member is supported by the other support member; and a spring member for urging said support members in a direction to move the tip ends of the ring members away from each other is provided between at least one of the support members and a side piece portion of the base portion. According to such an arrangement, the overall construction of the binding tool can be simplified, and besides, only by operating the switching lever, it is possible to operate the two support members at the same time thereby to selectively change the rings between the closed ring postures and their opened ring postures.

According to the binding tool for documents or the like of the present invention, by considering the three-dimensional shape of the base member and the structure of the bearing portions for the cam member, it is possible to suppress the height of the protruded portions from the surface of the base portion thereby to expand a space thereabove, and besides, the construction can be made easy to manufacture and assemble.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENT

Hereinafter, a preferred embodiment of the present invention will be described in detail while referring to the accompanying drawings.

Figure 1:
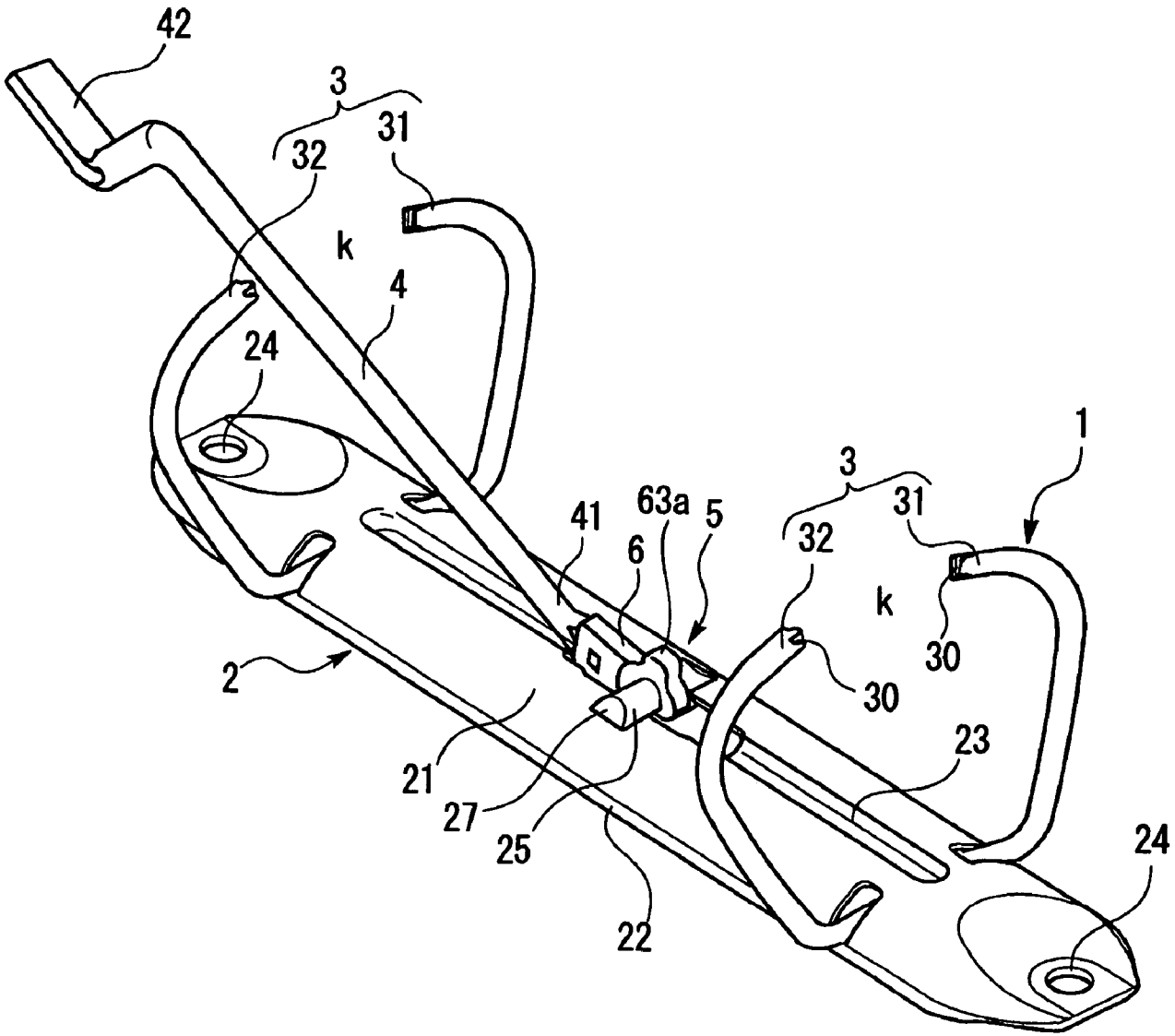
FIG. 1 is an overall perspective view of a binding tool according to an embodiment of the present invention.
Figure 2:
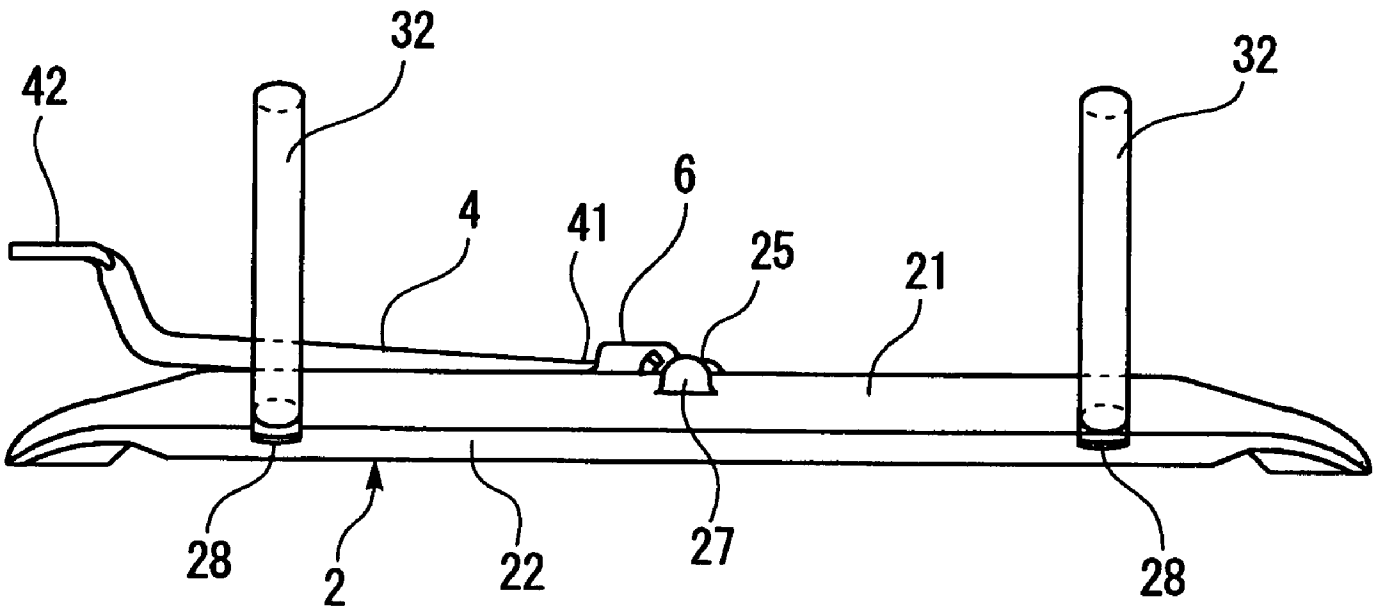
FIG. 2 is a side view of the binding tool with its rings closed according to the embodiment of the present invention.
Figure 3:
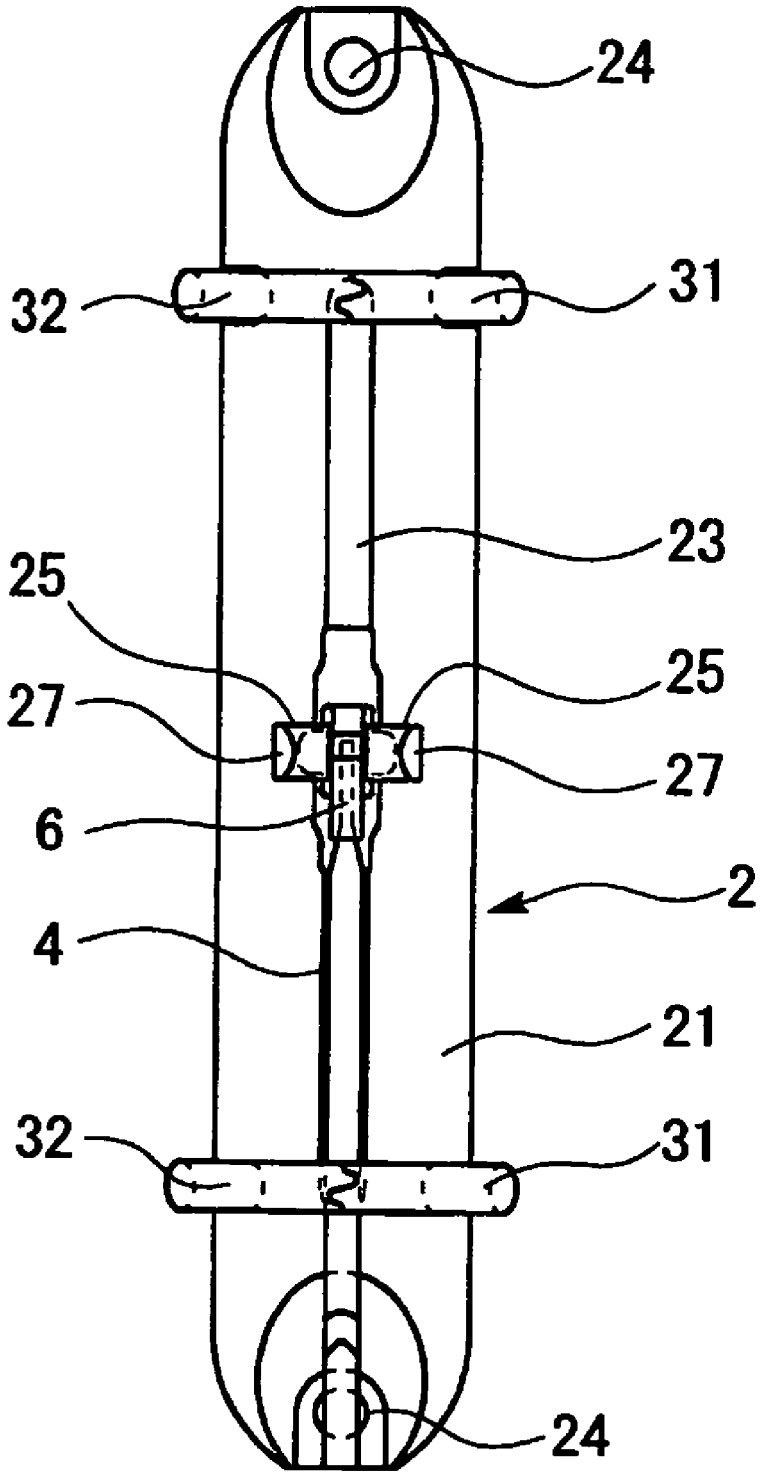
FIG. 3 is a plan view of the binding tool shown in FIG. 2 according to the embodiment of the present invention.
Figure 4:
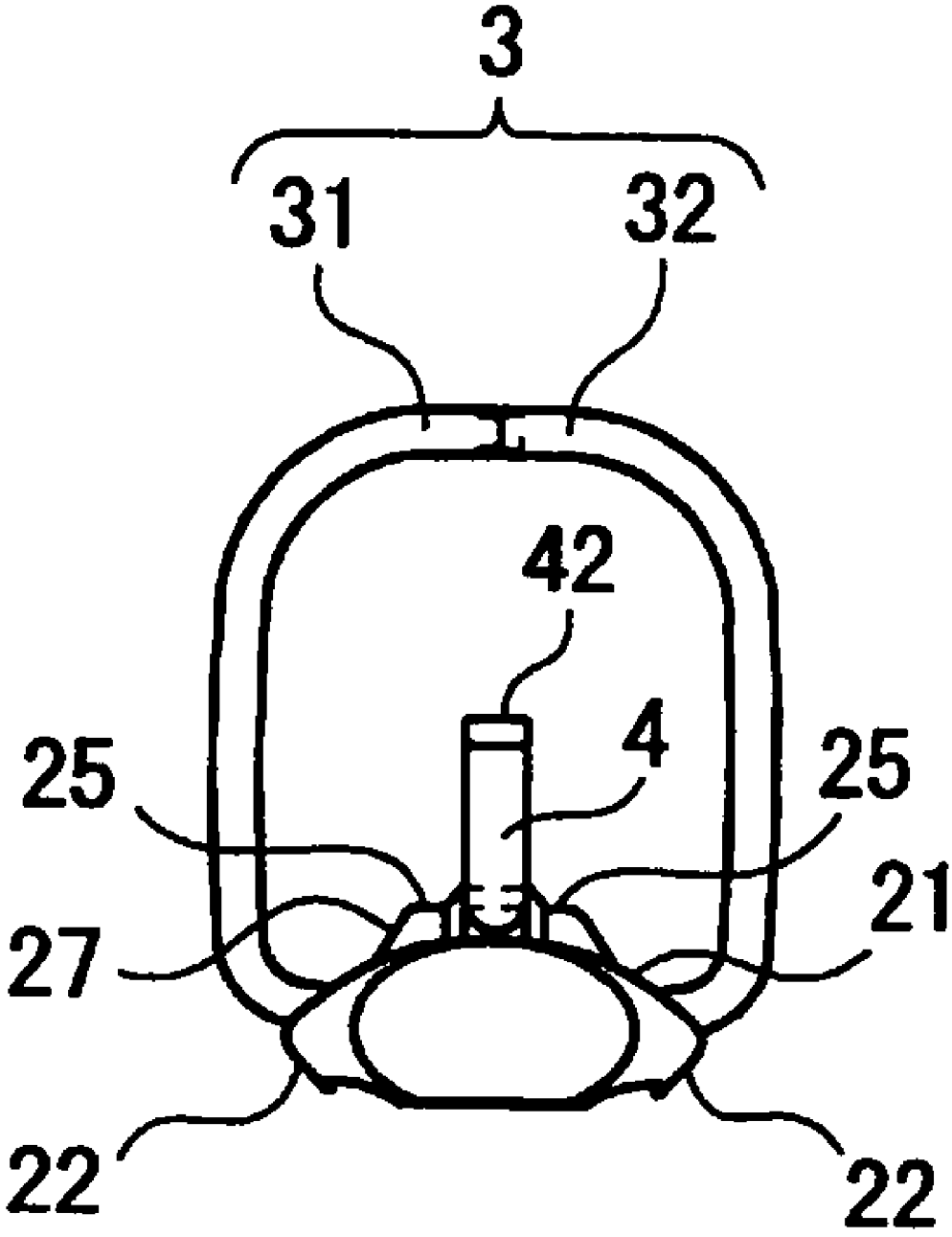
FIG. 4 is a front elevational view of the binding tool shown in FIG. 2 according to the embodiment of the present invention.
Figure 5:
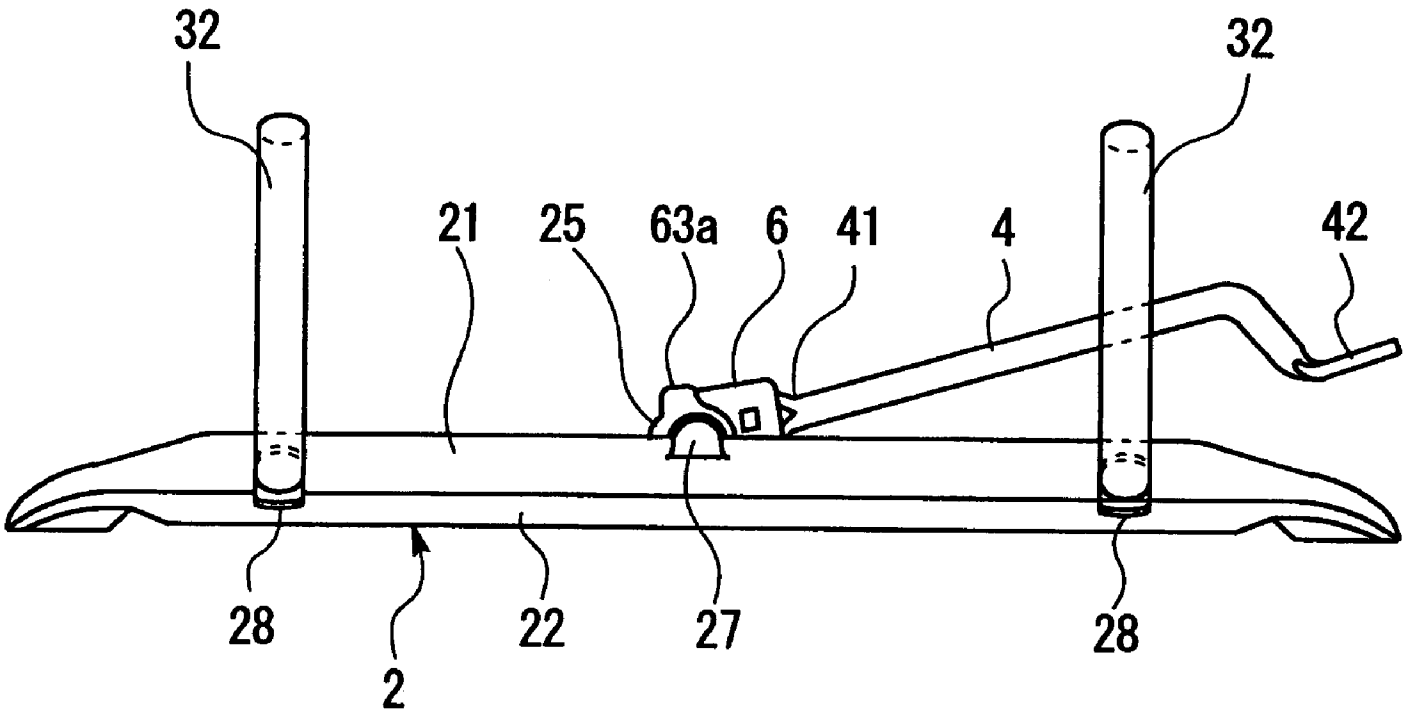
FIG. 5 is a side view of the binding tool with its rings opened according to the embodiment of the present invention.
Figure 6:
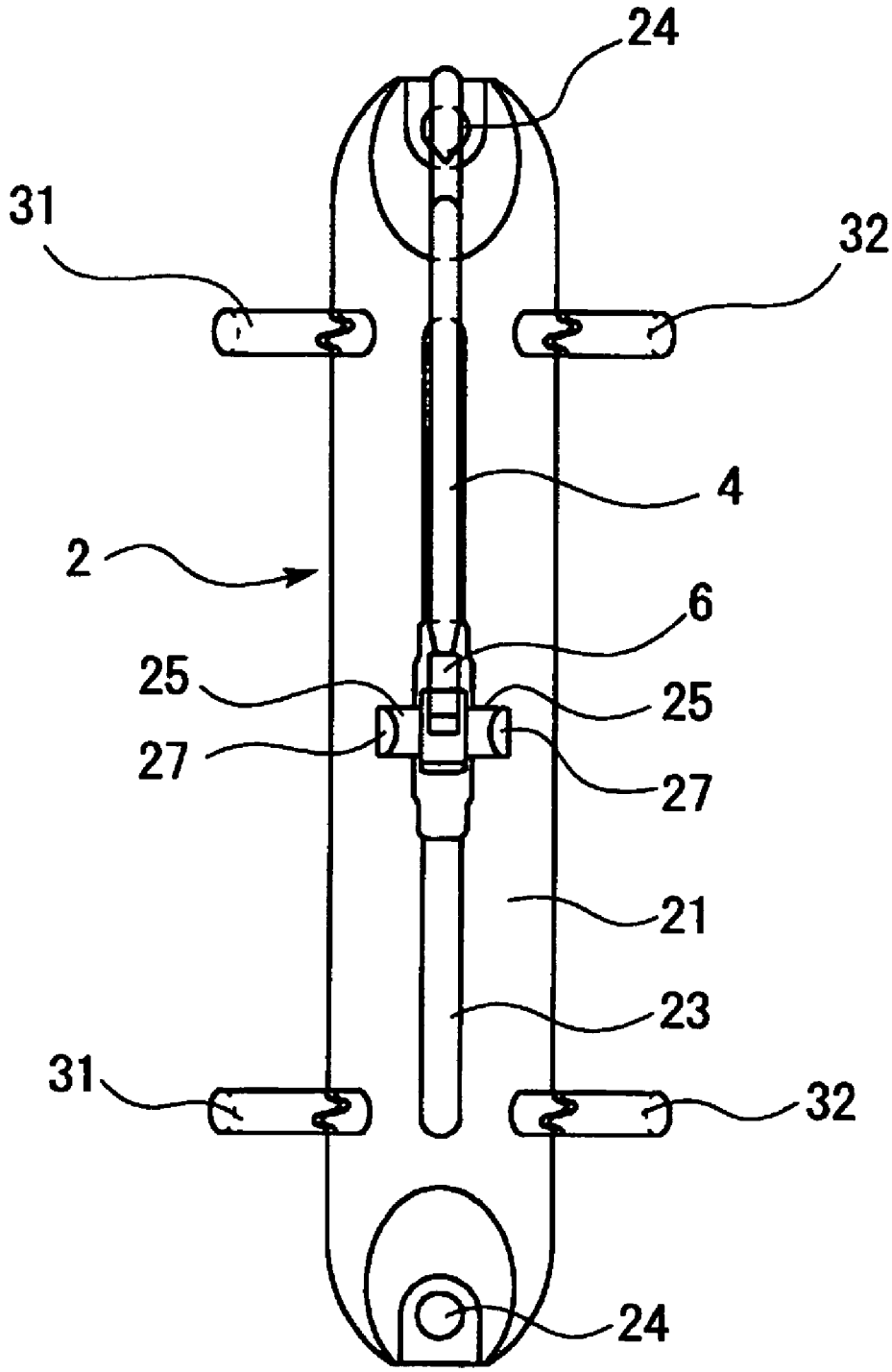
FIG. 6 is a plan view of the binding tool shown in FIG. 5 according to the embodiment of the present invention.
Figure 7:
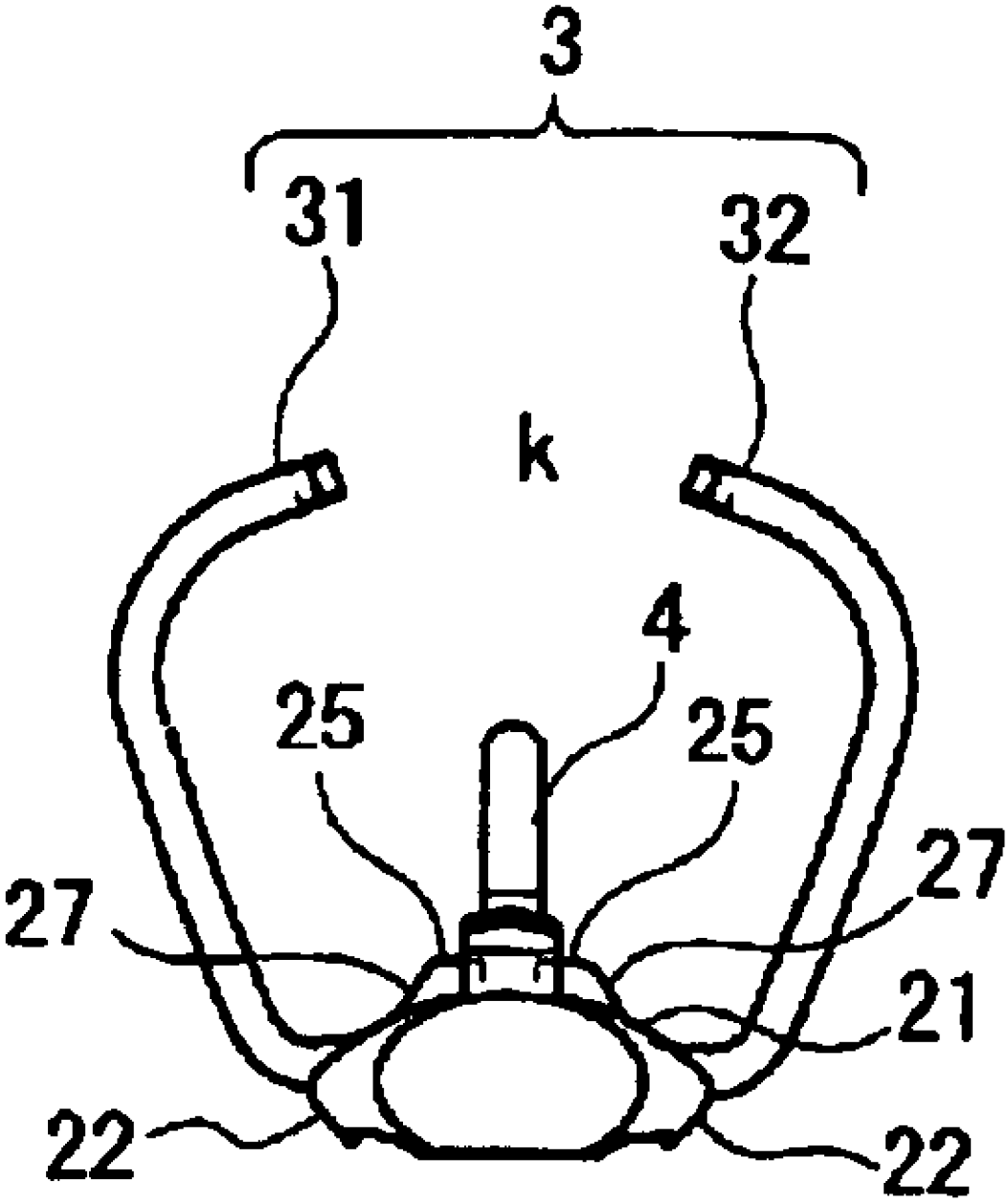
FIG. 7 is a front elevational view of the binding tool shown in FIG. 5 according to the embodiment of the present invention.
Figure 8:
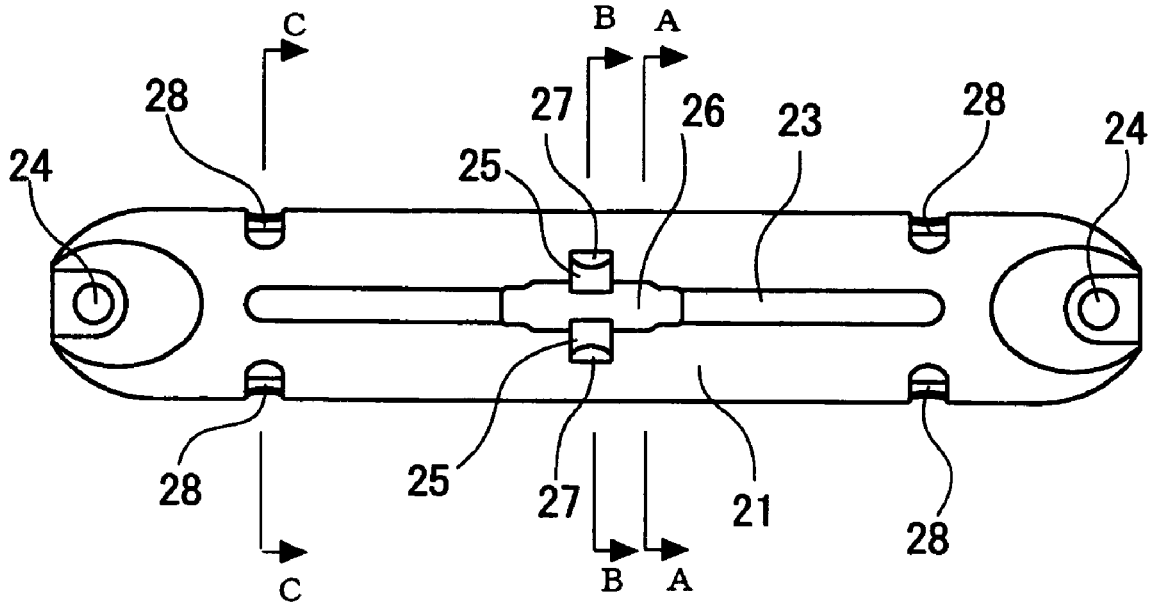
FIG. 8 is a plan view of a base portion of the binding tool according to the embodiment of the present invention.
Figure 9:
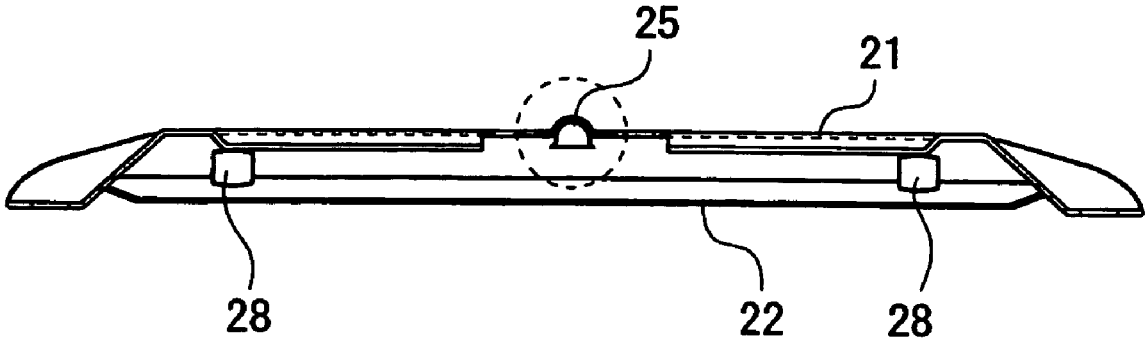
FIG. 9 is a cross section of the base portion of the binding tool according to the embodiment of the present invention.
Figure 10:
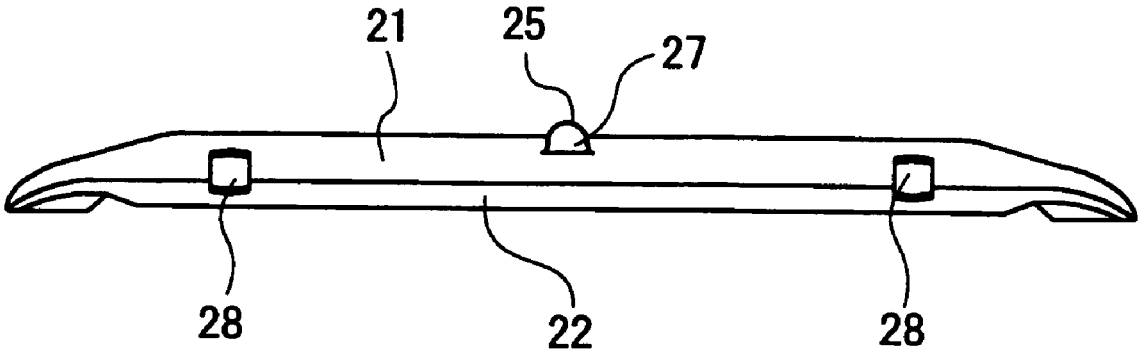
FIG. 10 is a side view of the base portion of the binding tool according to the embodiment of the present invention.
Figure 14:
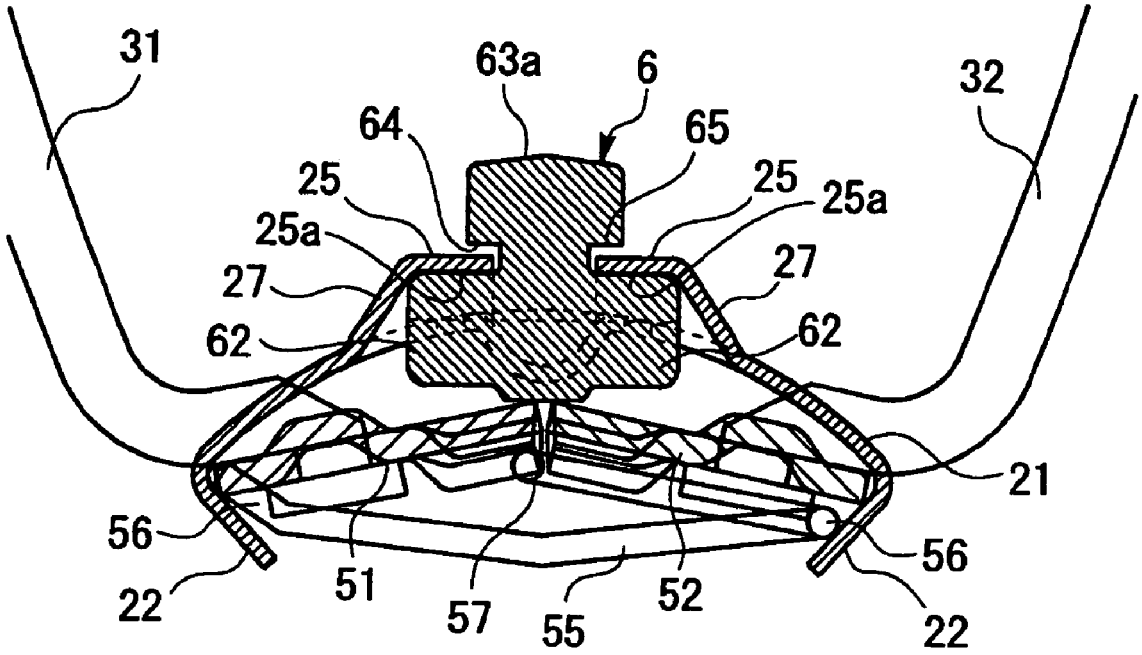
FIG. 14 is an enlarged cross sectional view of essential portions of the binding tool with its rings opened according to the embodiment of the present invention.
Figure 15:
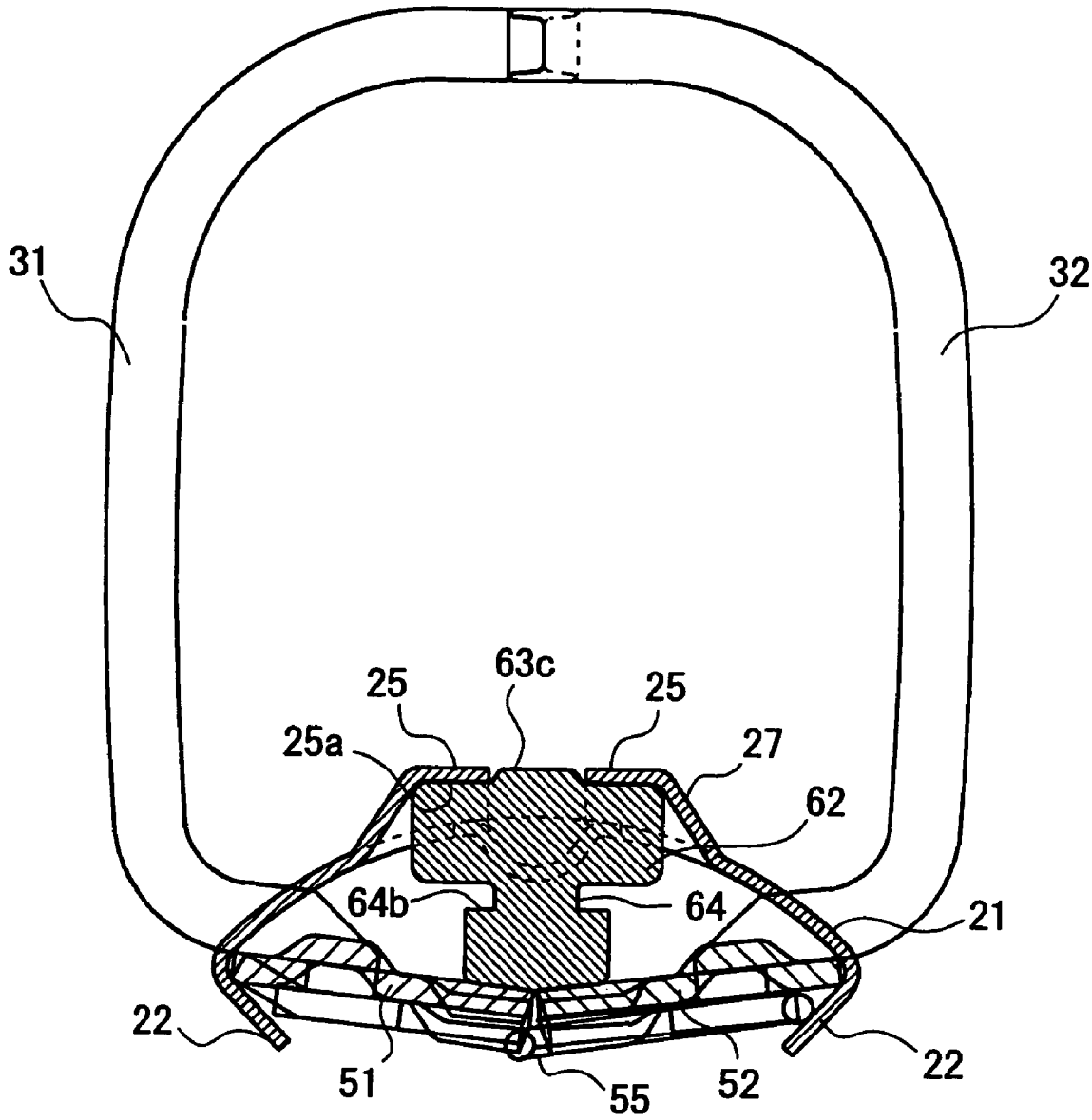
FIG. 15 is an enlarged cross sectional view of the essential portions of the binding tool with its rings closed according to the embodiment of the present invention.

Referring to the drawings and first to FIG. 1, there is shown, in a perspective view, a binding tool for documents or the like according to one embodiment of the present invention. FIG. 2 is a side elevational view of the binding tool in a state where rings of the binding tool are closed, FIG. 3 is a plan view thereof and FIG. 4 is a front elevational view thereof. FIG. 5 is a side elevational view of the binding tool in a state where the rings of the binding tool are opened, FIG. 6 is a plan view thereof, and FIG. 7 is a front elevational view thereof. FIG. 8 through FIG. 13 are views that show the construction of a base member, and FIG. 14 and FIG. 15 are enlarged cross sectional views of the essential portions of the binding tool with its rings opened and closed, respectively.

The binding tool, generally designated at 1, according to this embodiment is provided with a base portion (base plate) 2 formed of a metal plate, two rings 3, 3 that are mounted on the base portion 2 at an interval therebetween in a longitudinal direction (lengthwise direction) thereof, and a switching mechanism 5 with a switching lever 4. The two rings 3, 3 can be selectively changed into closed ring postures for binding documents, pieces of paper or the like, as shown in FIG. 2 through FIG. 4, and closed ring postures for releasing or opening a part of each of the closed rings, 3, 3 for insertion therein of the documents or the like, as shown in FIG. 5 through FIG. 7.

The switching lever 4 has a base end 41 and a free end 42, and a cam member 6 is provided on the base end 41 of the switching member 4 for adjusting the degree of opening/closing of each of the individual rings 3, 3 according to a rotated position of the free end 42 of the switching lever 4. The cam member 6 has a cam main body 61, a pair of camshafts 62, 62 that protrude from the cam main body 61 in opposite directions, and a cam surface 63 (see FIG. 14 through FIG. 19). The camshafts 62, 62 are supported by bearing portions 25, 25, respectively, to be described later.

The switching mechanism 5 is mounted on the base portion 2 for switching the rings 3, 3 between their closed ring postures and their opened ring postures. This switching mechanism 5 has the switching lever 4 mounted on the base portion 2 for swinging (rotating) motion relative thereto, and is designed in such a manner that when the rings 3, 3 are in their opened ring postures, the switching lever 4 is able to pass through an opened portion K of each of the rings 3, 3, as shown in FIGS. 1 and 5.

Now, detailed reference will be made to the above-mentioned components while referring to the individual figures.

The base portion 2 is formed, in this embodiment, by processing (e.g., bending or drawing) a piece of metal plate, as shown in FIG. 1 through FIG. 13. Specifically, the base portion 2 has a base main body 21 and a pair of side piece portions 22, 22 at opposite sides thereof, which are formed by processing the metal plate in the following manner. That is, the base main body 21 is processed to be curved in an upward direction, as a whole, to form a front surface (top plate) of the base portion 2, and the side piece portions 22, 22 are curved in such a manner as to incline toward a rear surface side of the base main body 21 to form side surfaces (side plates) of the base portion 2. These side piece portions 22, 22 are subjected to bending processing upon assembly of the binding tool 1.

The base main body 21 is formed into a strip-like elongated shape, as viewed from the upper surface thereof, and has fastening holes 24 formed therethrough at locations near its opposite longitudinal ends, respectively, for fixedly securing itself to an inner surface of a cover body of a binder for example by means of screws, rivets, etc. On the front surface of the base main body 21, there is formed a groove-like concave portion 23 that is downwardly curved in a semi-circular shape in cross section. The concave portion 23 is located in the widthwise center of the base main body 21 and extends in a longitudinal direction of the base main body 21. The concave portion 23 has a groove width formed to be wider than the width of the lever 4. As a result, it is considered that a part of the switching lever 4 can be inserted into the concave portion 23 thereby to ensure that the rings 3, 3 can take their opened ring postures and the closed ring postures in a reliable manner.

The bearing portions 25, 25 for the camshafts 62, 62 are formed in the central portion of the base main body 21. The bearing portions 25, 25 are defined by inner surfaces 25*a*, 25*a* of curved portions that are formed by curving a part of the base main body 21 so as to bulge to its front surface side. The bearing portions 25, 25 are semicircular in cross section, with its opened portion being directed to a rear surface side (lower side) of the base main body 21. An opening 26 is formed between the bearing portions 25, 25 of the base main body 21 so that the cam member 6 can be disposed in the opening 26. Accordingly, the cam member 6 is set from the rear surface side of the base main body 21.

The surfaces of the bearing portions 25, 25 of the base main body 21 are formed into sloped surfaces 27, 27 that incline downwardly toward the side piece portions, respectively, of the base portion 2. These sloped surfaces 27, 27 are provided for the purpose of smoothly guiding the end edges of the documents or the like to be filed or bound so as to prevent them from being put into contact with and being caught by the raised bearing portions 25, 25.

The bearing portions 25, 25 are arranged in the center between the two rings 3, 3, and constitute a part of hinges of the switching lever 4. That is, the bearing portions 25, 25, being each upwardly curved into a semicircular shape in cross section, are arranged on the base main body 21 in opposition to each other with a space or distance being formed therebetween in a widthwise direction of the base main body 21, so that the camshafts 62, 62 are inserted into the inner surfaces of the bearing portions 25, 25. In this manner, the bearing portions 25, 25 are formed so as to suppress the height of the switching mechanism 5.

The base portion 2 has slot-like notches 28, 28 formed to extend from the vicinities of the widthwise opposite sides of the base main body 21 to the side piece portions 22, 22, respectively, for permitting the ring members 31, 32 to be described later to protrude therethrough to above the base main body 21.

In addition, the side piece portions 22, 22 at the widthwise opposite sides of the base main body 21 are formed with bent portions 29, 29, respectively, that support, at their inner surfaces, support members 51, 52 to be described later for swinging (tilting) motion. Each of the bent portions 29, 29 extends in the longitudinal direction of the base main body 21.

The reason for forming the base main body 21, the side piece portions 22, 22 and the bearing portions 25, 25 by processing the single metal plate is to reduce the number of component parts required, simplify the overall construction, and enhance the processing or working accuracy. Further, by forming the base main body 21 itself into a shape to serve as a cover, it is also possible to improve the external appearance and safety of the binding tool.

Each of the rings 3, 3 has a first ring member 31 and a second ring member 32 which can take a closed ring posture with their tip ends 30 being in contact with each other and an opened ring posture with their tip ends 30 being apart from each other. The switching mechanism 5 is constructed to operate the tip ends 30 of each of the ring members 31, 32 to move toward or away from each other, whereby it is considered that the degree of opening of each ring 3 (the length of an opened portion K) in the form of a maximum spaced-apart distance between the tip ends 30 can be increased, thus making it possible to improve workability or operability for insertion or removal of documents or the like.

Each of the ring members 31, 32 is formed substantially in bilateral symmetry, as viewed from the front side thereof. Accordingly, the opened portion K (see FIG. 1 and FIG. 7) of each ring formed when the tip ends 30 of each of the ring members 31, 32 are separated or spaced from each other is located above the base portion 2 and in the widthwise center of the base portion 2 (the base main body), whereby it is constructed such that the opening/closing timing of the rings 3, 3 with respect to the rotational position of the switching lever 4 can be set easily. That is, the construction is made such that the relation between the rotational angle of the switching lever 4 and the opening/closing angle of the rings 3, 3 can be designed easily.

The cam member 6, being arranged at the base end 41 of the switching lever 4, is provided with the cam surface 63 for adjusting the degree of opening/closing of each ring 3 according to a rotational position of the free end 42 of the switching lever 4. In this manner, by making adjustable the degree of opening/closing of each ring 3 only by the operation of the switching lever 4, it is possible to set the relation between the operation angle of the switching lever 4 and the opening/closing angle of each ring 3 in a freely adjustable manner. Accordingly, the present invention is not limited to the ring members 31, 32 of right and left symmetry, but can be applied to a variety of shapes of rings.

Though the switching lever 4 itself is formed of a bent metal rod, the cam member 6 is fixedly secured to the base end 41 of the switching lever 4, and the cam surface 63 is formed on the cam main body 61 of the cam member 6. The cam member 6 is formed with a mounting hole 65 into which the base end 41 of the switching lever 4 is inserted so as to be attached thereto. The cam member 6 is made of synthetic resin such as polyacetal resin.

Figure 18:
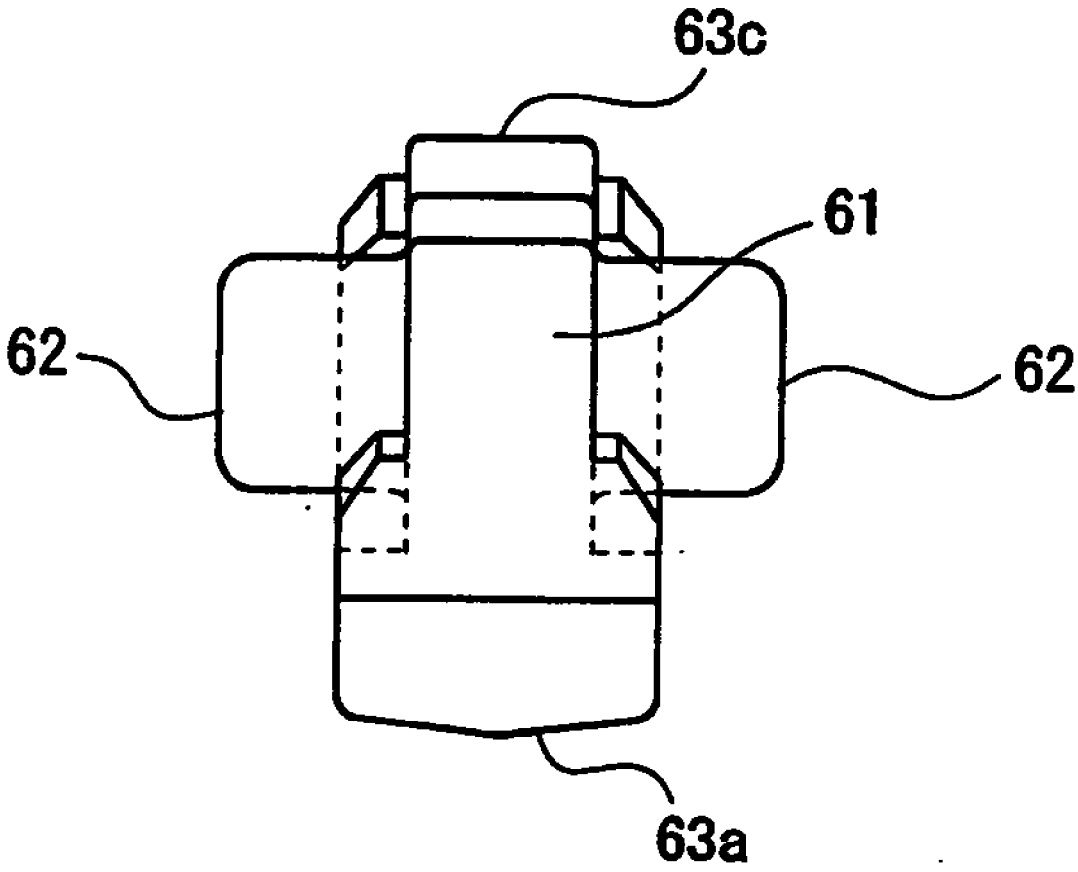
FIGS. 18(*a*) through 18(*c*) show a cam member of the binding tool as viewed in a longitudinal direction thereof according to the embodiment of the present invention, wherein FIG. 18(*a*) is a plan view thereof, FIG. 18(*b*) is a cross sectional plan view thereof, and FIG. 18(*c*) is a bottom view thereof.
Figure 18:
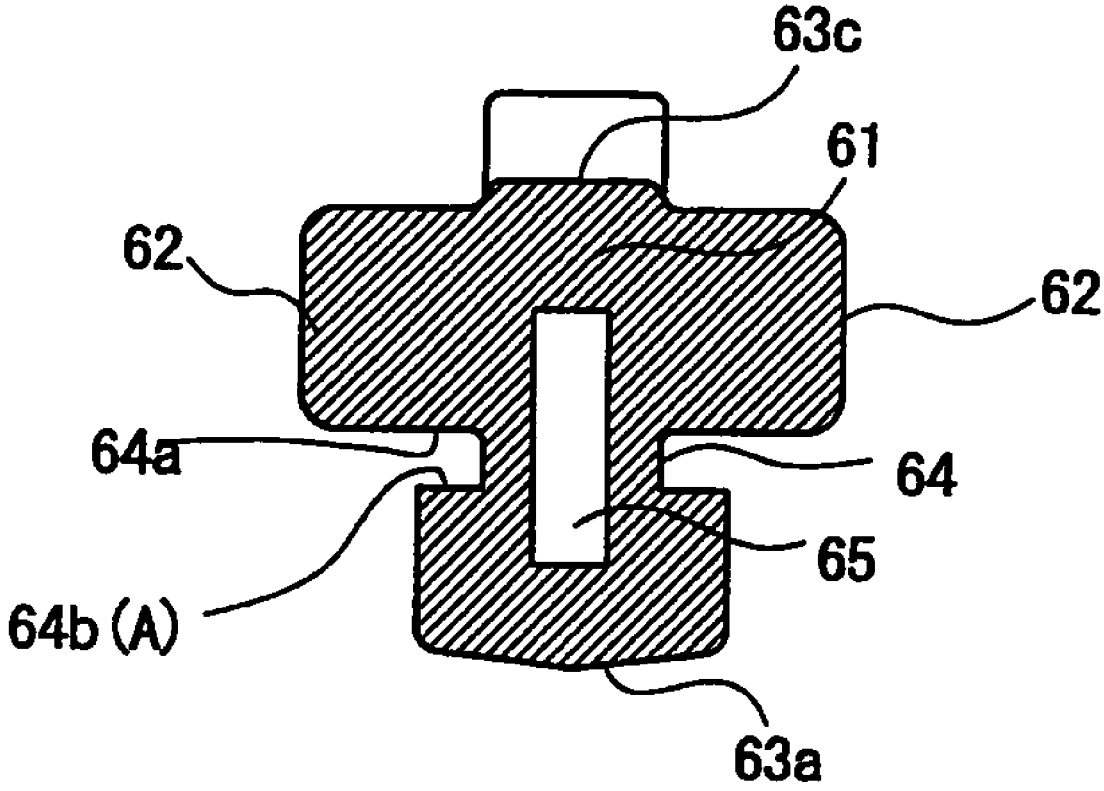
Figure 18:
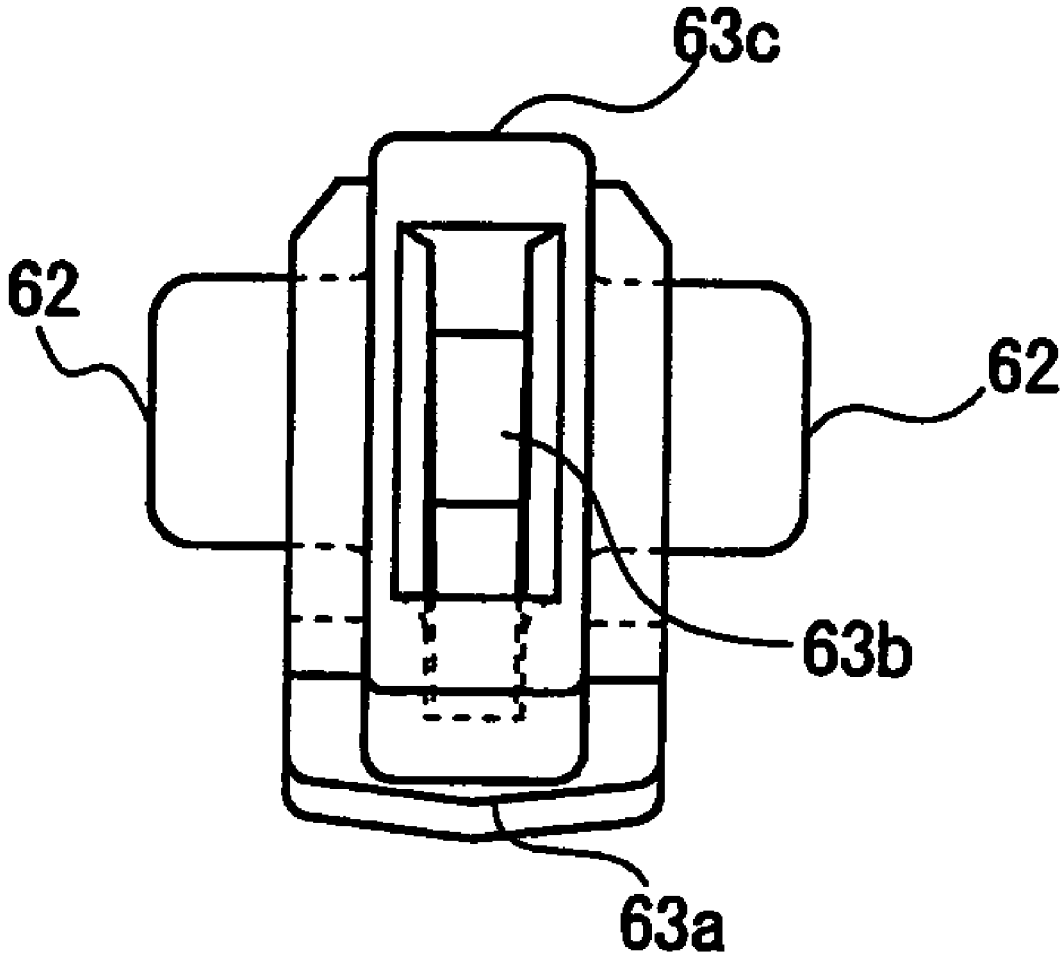
Figure 19:
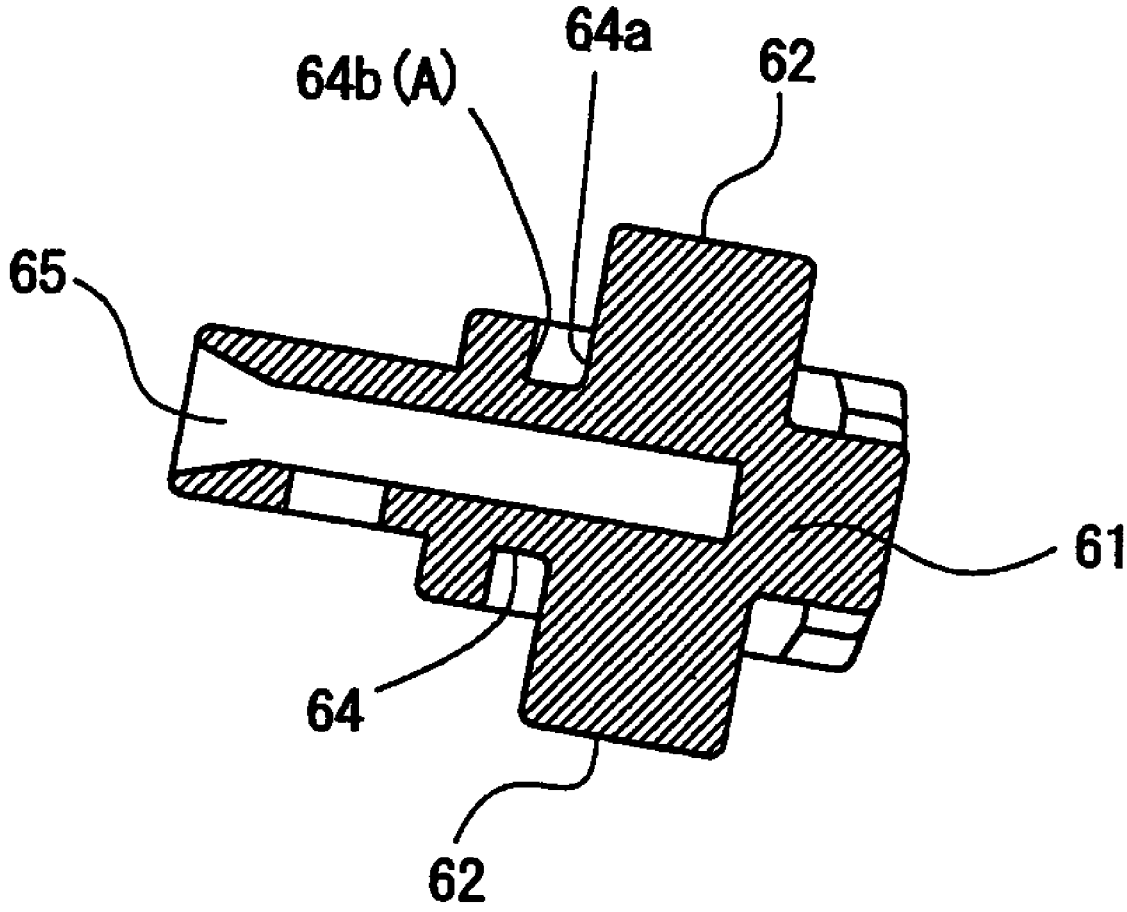
FIGS. 19(*a*) through 19(*c*) show a cam member of the binding tool as viewed in a widthwise direction thereof according to the embodiment of the present invention, wherein FIG. 19(*a*) is a cross sectional plan view thereof, FIG. 19(*b*) is a side elevation thereof, and FIG. 19(*c*) is a cross sectional side view thereof.
Figure 19:
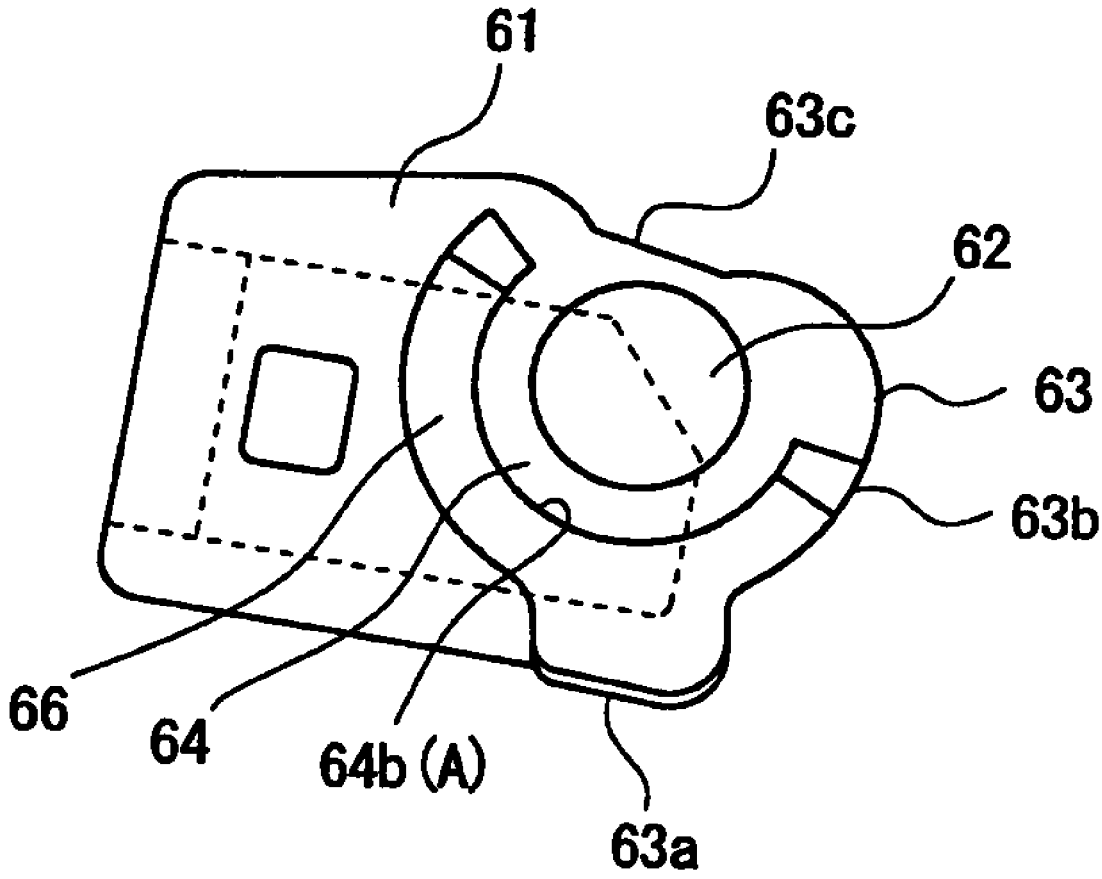
Figure 19:
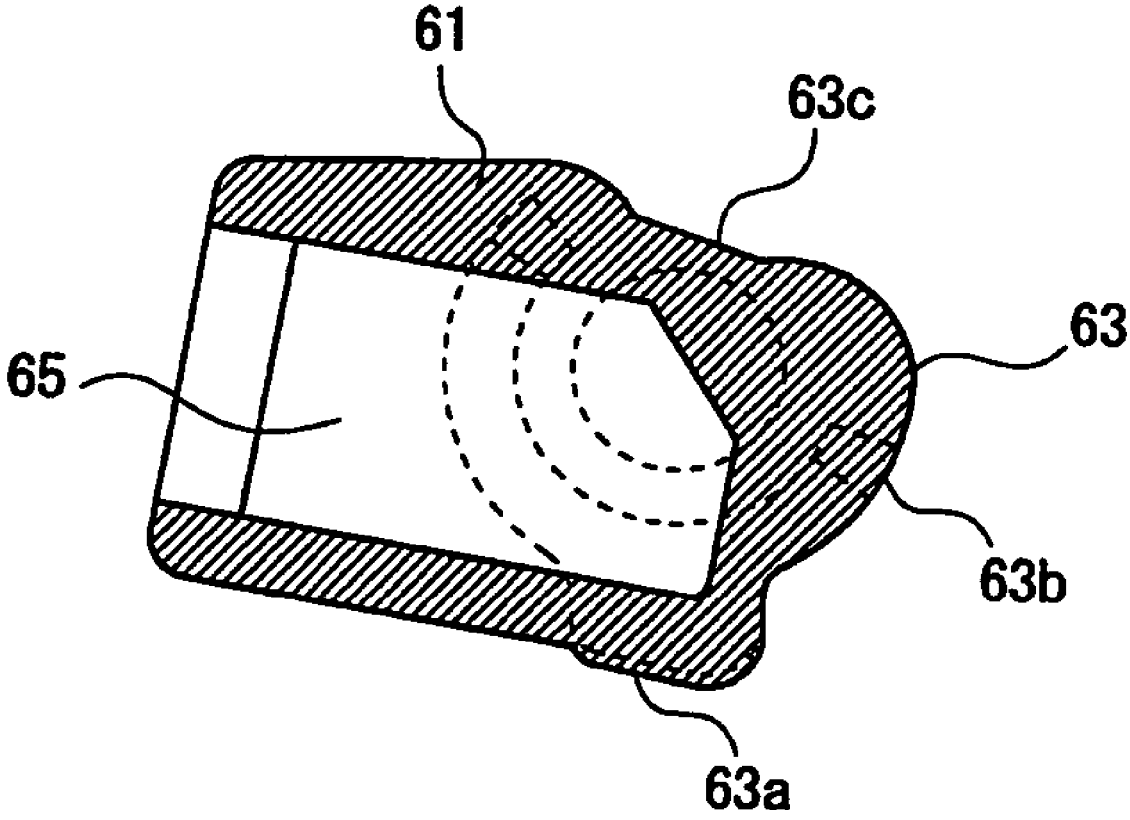

The cam member 6 has the cam main body 61 and the camshafts 62, 62 formed integrally with one another, as shown in FIG. 18 and FIG. 19. The camshafts 62, 62 protrude respectively from the opposite side surfaces of the cam main body 61 in alignment with each other. Each camshaft 62 has a curvature of its outer peripheral surface that is smaller about an amount of tolerance of fitting engagement than a curvature of the inner surface of each bearing portion 25.

The cam main body 61 has contact portions A, A formed on its opposite side surfaces in parallel to the outer peripheries of the camshafts 62, 62 so as to contact the surfaces of the bearing portions 25, 25 respectively, thereby to restrict the downward displacements of the camshafts 62, 62. That is, circular-arc shaped grooves 64, 64 for constituting the contact portions A, A are formed between the cam main body 61 and the camshafts 62, 62, respectively. The circular-arc shaped grooves 64, 64 are formed to curve in an arcuate shape (a semicircular shape) so that the ends of the right and left bearing portions 25, 25, arranged in opposition to each other with the opening 26 of the base main body 21 being located in the center, can be moved into the grooves 64, 64, respectively. The groove width of these circular-arc shaped grooves 64, 64 is formed slightly greater than the thickness of those portions of the metal plate which form the bearing portions 25, 25, so due consideration is given so as not to generate an excessive amount of play more than necessary.

As shown in FIG. 18 and FIG. 19, one groove wall 64*a* among two groove walls at the opposite sides of each circular-arc shaped groove 64 is formed of a part of the outer peripheral surface of a corresponding camshaft 62, whereas the other groove wall 64*b* is formed of a part of a flange-shaped rib 66 which extends along a circumferential direction of the corresponding camshaft 62 in a semicircular shape. In other words, the circular-arc shaped grooves 64, 64 are formed by the flange-shaped ribs 66, 66 which are arranged apart a distance of the groove width from the camshafts 62, 62, respectively.

Figure 16:
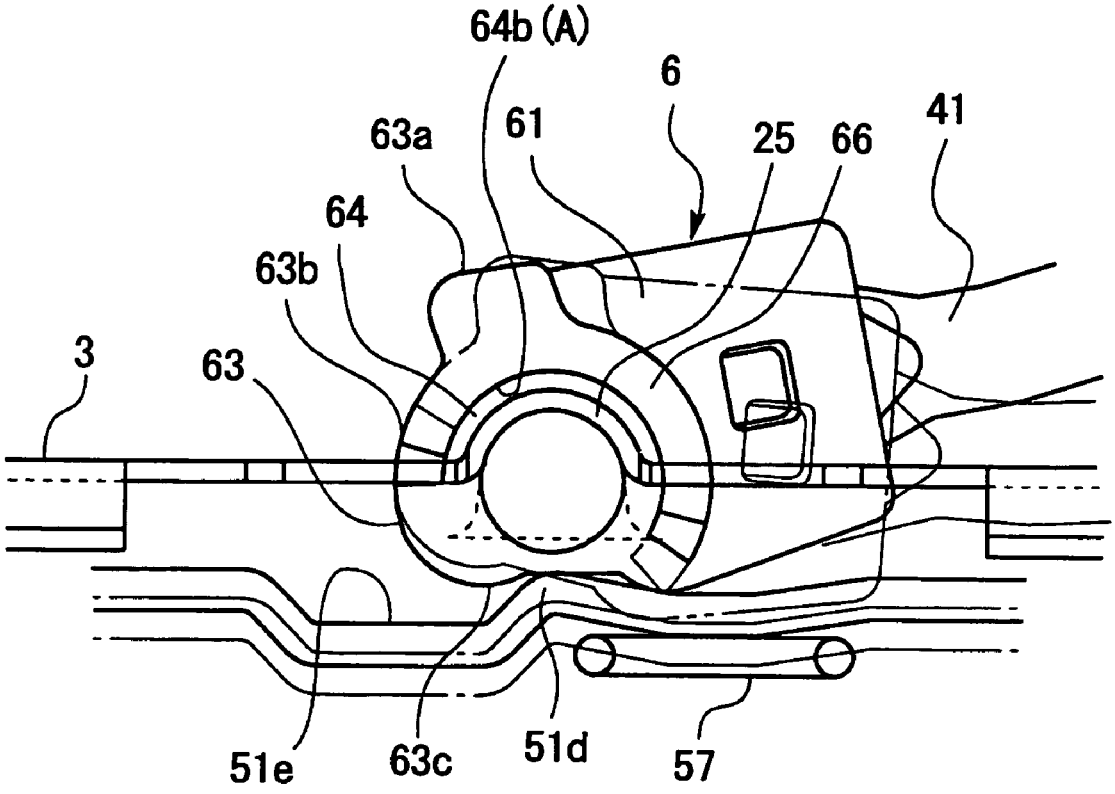
FIG. 16 is an explanatory view of an operation of the essential portions of the binding tool at its one operational position according to the embodiment of the present invention.

The circular-arc shaped grooves 64, 64 serve to keep the camshafts 62, 62 at fixed positions so as to prevent the camshafts 62, 62 from downwardly displacing (falling) from the bearing portions 25, 25. That is, the circular-arc shaped grooves 64, 64 exert the function of preventing the camshafts 62, 62 or the cam member 6 from being displaced downward by means of the contact of the other groove walls 64*a*, 64*a* with the upper surfaces of the bearing portions 25, 25 when the rotational position of the cam member 6 is at a position to change the rings 3 to their opened ring postures, as shown in FIG. 16. Accordingly, the other groove walls 64*a*, 64*a* constitute the contact portions A, A, respectively.

Figure 17:
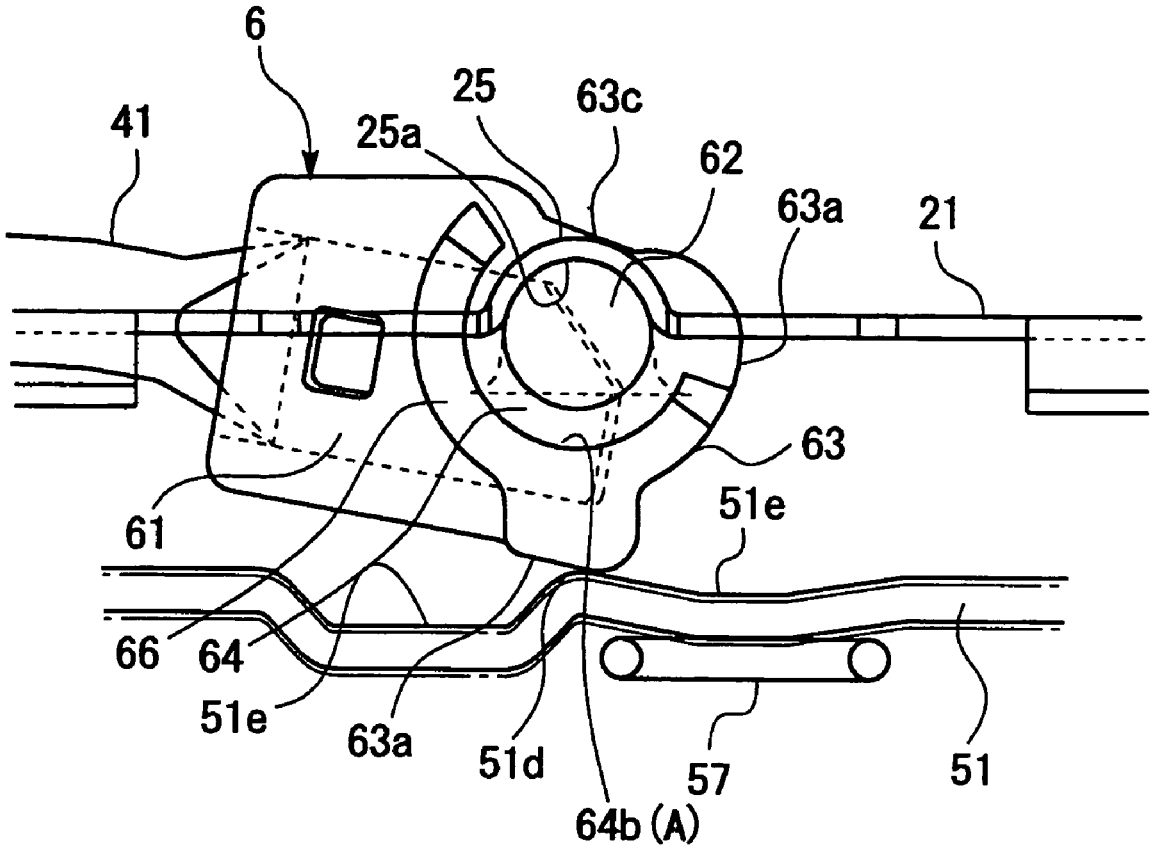
FIG. 17 is an explanatory view of an operation of the essential portions of the binding tool at its other operational position according to the embodiment of the present invention.

The cam surface 63 has a first cam surface 63*a* that keeps the rings 3, 3 at their closed ring postures, a second cam surface 63*b* that shifts the rings 3, 3 from their closed ring postures to their opened ring postures, as shown in FIG. 15 and FIG. 17, and a third cam surface 63*c* that keeps the rings 3, 3 at their opened ring postures, as shown in FIG. 14 and FIG. 16.

The switching mechanism 5 has two support members (boost plates) 51, 52 that are arranged side by side at the rear surface side of the base main body 21, and are each tiltable to a side orthogonal to the longitudinal direction of the base main body 21. The base end of each first ring member 31 is fixedly secured to and supported by one support member 51, whereas the base end of each second ring member 32 is fixedly secured to and supported by the other support member 52. The support members 51, 52 are each formed so as to extend in the longitudinal direction of the base main body 21. Accordingly, the first ring members 31, 31 and the second ring members 32, 32 are fixedly secured to the vicinities of the longitudinally opposite ends of the support members 51, 52, respectively.

Each of the individual support members 51, 52 is formed of a metal plate and takes a strip-like configuration having one side portion and the other side portion, respectively. The one side portions of the individual support members 51, 52 are respectively supported by the inner surfaces of the bent portions 29, 29 of the side piece portions 22, 22 of the base portion 2, and the other side portions are partially superposed with each other in a vertical direction.

Figure 20:
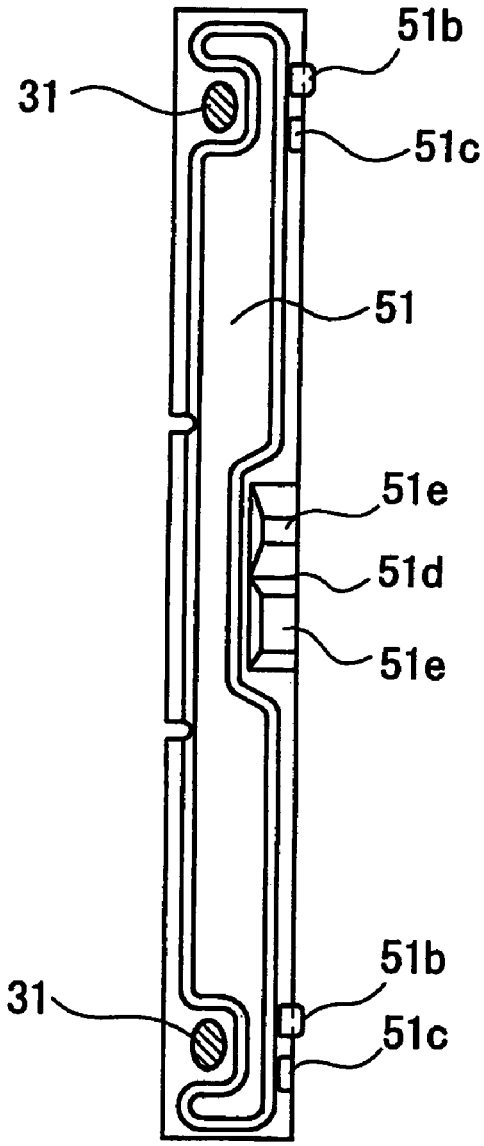
FIGS. 20(*a*) and 20(*b*) show one of two support members of the binding tool according to the embodiment of the present invention, wherein FIG. 20(*a*) is a plan view thereof, and FIG. 20(*b*) is a side elevation thereof.
Figure 20:
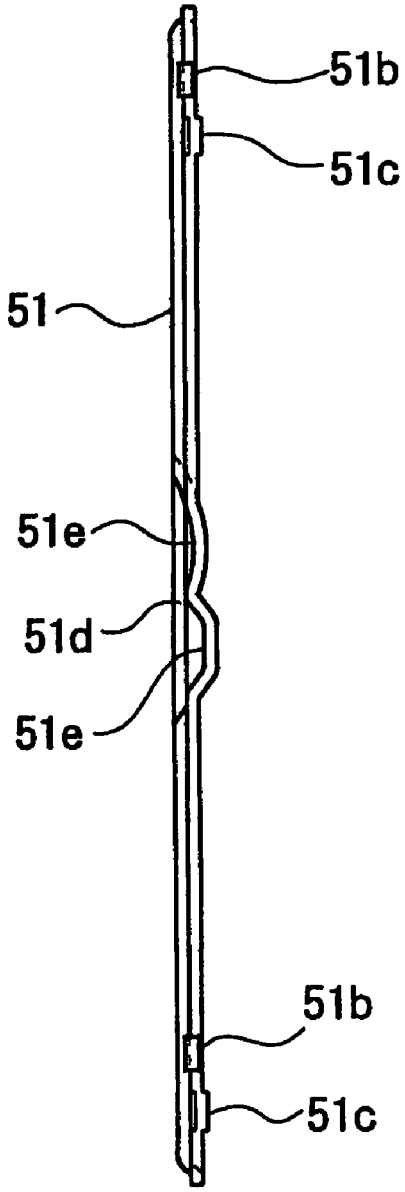
Figure 21:
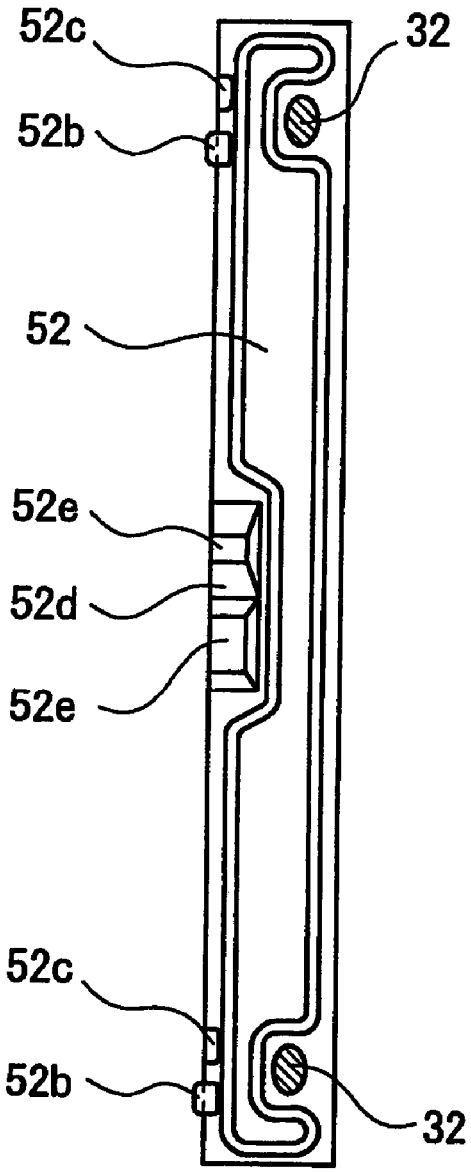
FIGS. 21(*a*) and 21(*b*) show the other support member of the binding tool according to the embodiment of the present invention, wherein FIG. 21(*a*) is a plan view thereof, and FIG. 21(*b*) is a side elevation thereof.
Figure 21:
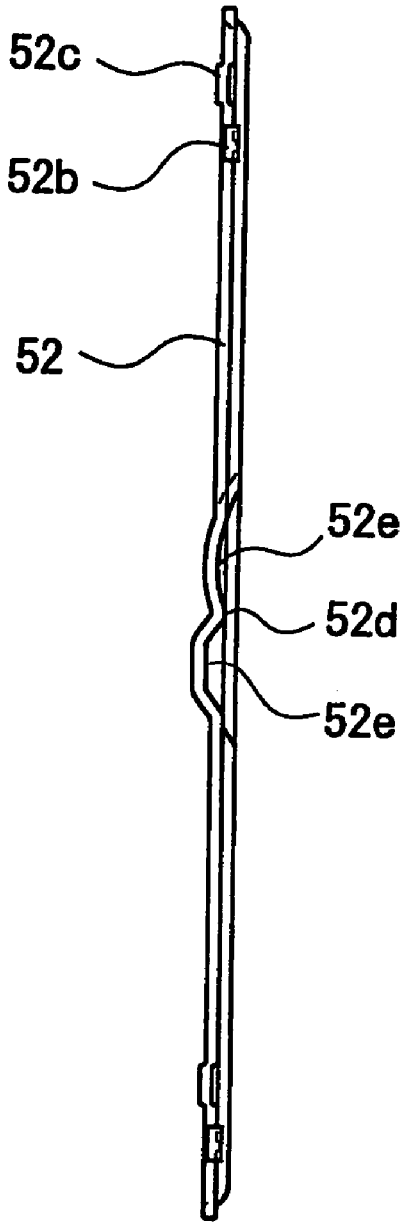

Each of the individual support members 51, 52 is also formed by processing one piece of metal plate, and is substantially in bilateral symmetry in plan, as shown in FIG. 20 and FIG. 21. Here, note that there is some difference between both of the individual support members 51, 52 in the provision of lap portions to be described later.

That is, a left side of the support member 51 and a right side of the support member 52, as viewed in front of the binding tool 1, are placed into abutment against and supported by the bent portions 29, 29 formed on the side piece portions 22 at the opposite sides of the binding tool 1. As a result, both of the support members 51, 52 are supported by the corresponding side piece portions 22, 22, respectively, in a swingable and temporarily engaged manner.

Further, the left support member 51 and the right support member 52 have the lap portions that are overlapped with each other in the vertical direction, i.e., one over the other. In this embodiment, two protruded segments 52*b*, 52*b* and two protruded segment receiving portions 52*c*, 52*c* are formed at intervals on the other side portion of the right support member 52. On the other side portion of the left support member 51, two protruded segment receiving portions 51*c*, 51*c* and two protruded segments 51*b*, 51*b* are formed at intervals at locations in opposition to the individual protruded segments 52*b*, 52*b* and the individual protruded segment receiving portions 52*c*, 52*c*, respectively, of the right support member 52.

Under the protruded segments 51*b*, 51*b* of the left support member 51, there are arranged the protruded segment receiving portions 52*c*, 52*c* of the right support member 52 in opposition to them, respectively, in a mutually overlapped manner. In addition, on the protruded segment receiving portions 51*c*, 51*c* of the left support member 51, there are arranged the protruded segments 52*b*, 52*b* of the right support member 52 in opposition to them, respectively, in a mutually overlapped manner.

Contact portions 51*d*, 52*d* for contact with the cam surface 63 of the cam member 6 are formed in the central portion on the other side of each of the support members 51, 52, respectively (see FIG. 14 through FIG. 21). At locations fore and aft of the contact portions 51*d*, 52*d* (i.e., longitudinally fore and aft of the support members), concave surfaces 51*e*, 52*e* are formed so as to provide a relative step height with respect to the contact portions 51*d*, 52*d*.

Among the cam surface 63, the first cam surface 63*a* comes into contact with the contact portions 51*d*, 52*d* thereby to push down the other side piece portions of the support members 51, 52, as shown in FIG. 15 and FIG. 17, when the rings 3 are in their closed ring postures, whereas the contact portions 51*d*, 52*d* come into contact with the third cam surface 63*c* thereby to push up the other side piece portions of the support members 51, 52, as shown in FIG. 14 and FIG. 16, when the rings 3 are in their opened ring postures. Here, note that the force that pushes up the other side piece portions of the support members 51, 52 is obtained by a spring member 55.

That is, the spring member 55 for urging the support member 52 in a direction to move the tip ends 30 of the ring members 31, 32 away from each other is set between both of the support members 51, 52 and the side piece portions 22 of the base main body 21. Here, note that in this embodiment, the spring member 55 is constructed so as to act on only one support member 51 for the purpose of accordingly simplified construction. This is because even with such a construction, only by operating the switching lever 4, it is possible to operate the two support members 51, 52 at the same time thereby to selectively change the rings 3 between the closed ring postures and their opened ring postures.

Figure 22:
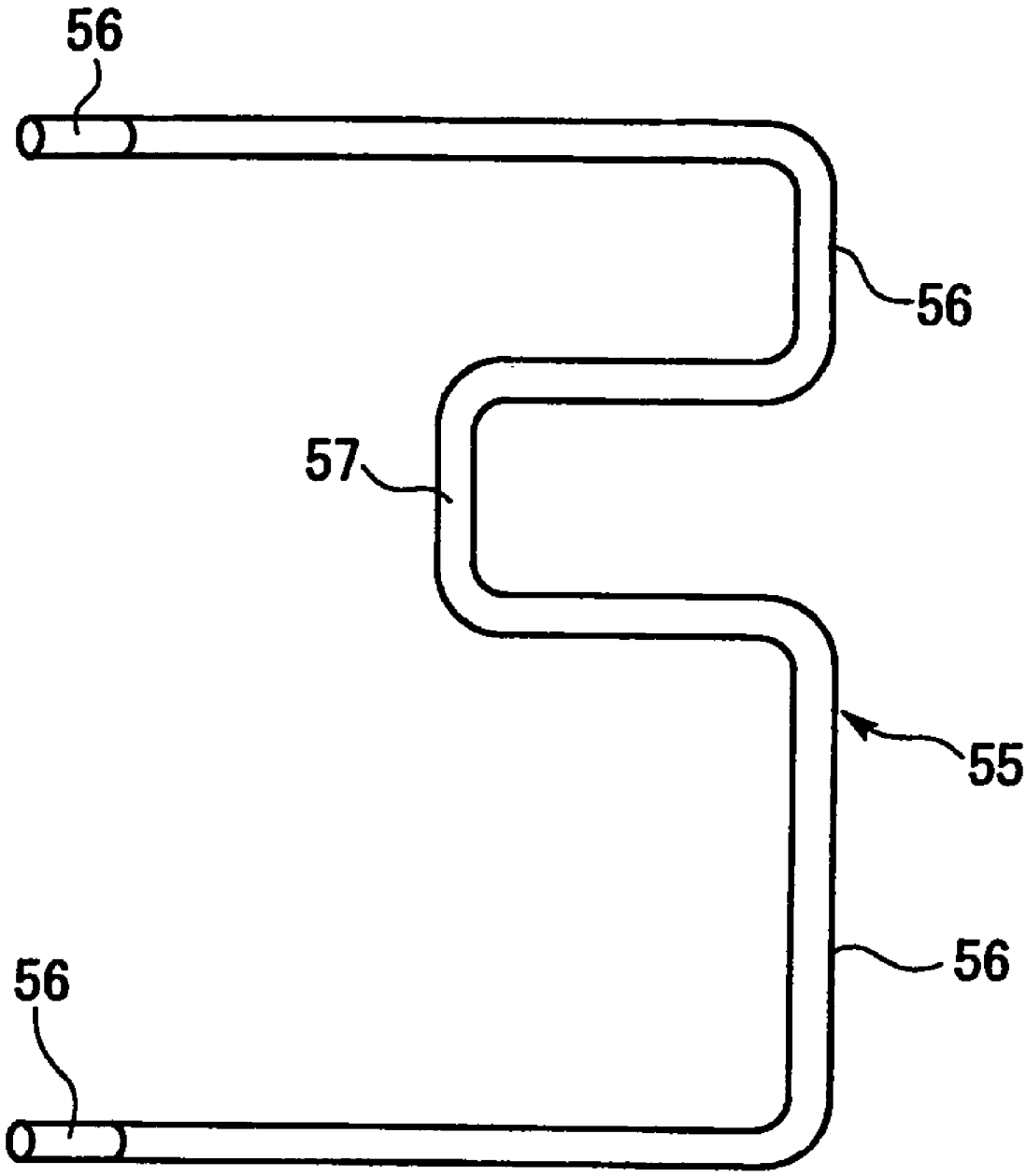
FIGS. 22(*a*) and 22(*b*) show a spring member of the binding tool according to the embodiment of the present invention, wherein FIG. 22(*a*) is a plan view thereof and FIG. 22(*b*) is a side elevation thereof.
Figure 22:
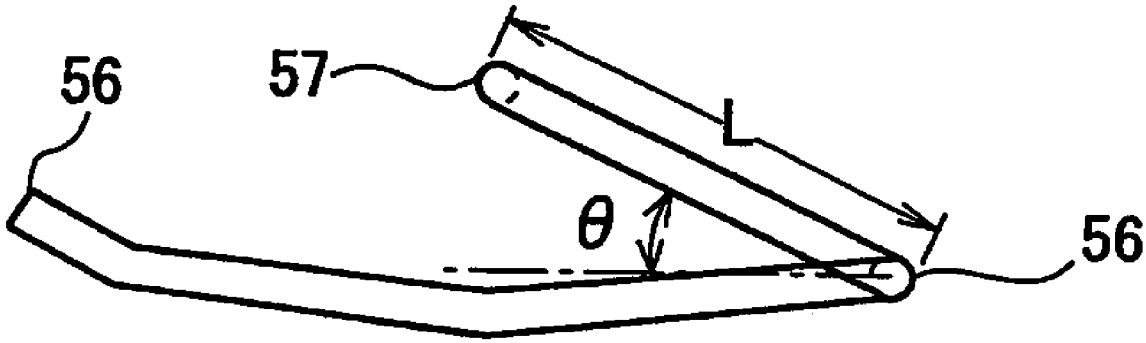

The spring member 55 is of a substantially M shape in plan, as shown in FIG. 22, is formed by bending processing of a wire rod, and has four fulcrum portions 56 and one urging portion 57. The four fulcrum portions 56 are set in a form to abut against the inner surfaces of the side piece portions 22 at the opposite sides of the base portion 2. In this state, the rising angle θ and the length L of the one urging portion 57 are properly set in such a manner that the one urging portion 57 is placed in contact with the rear side of the support member 51 thereby to urge the other side piece portion of the support member 51 in an upward direction (i.e., toward the rear surface of the base main body 21).

Figure 11:
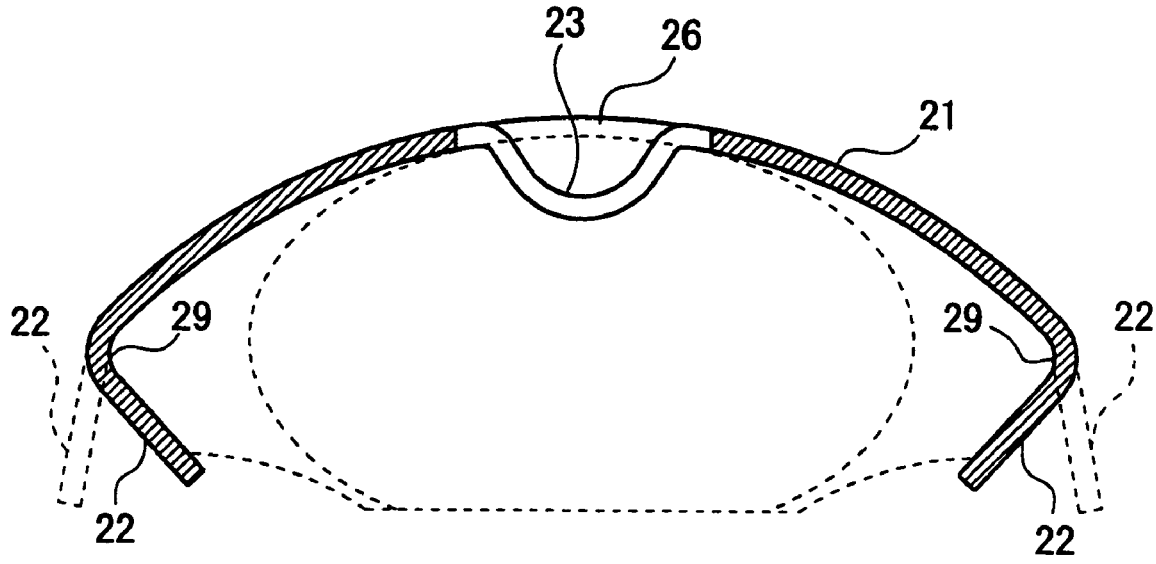
FIG. 11 is an enlarged cross sectional view along line A-A in FIG. 8.
Figure 12:
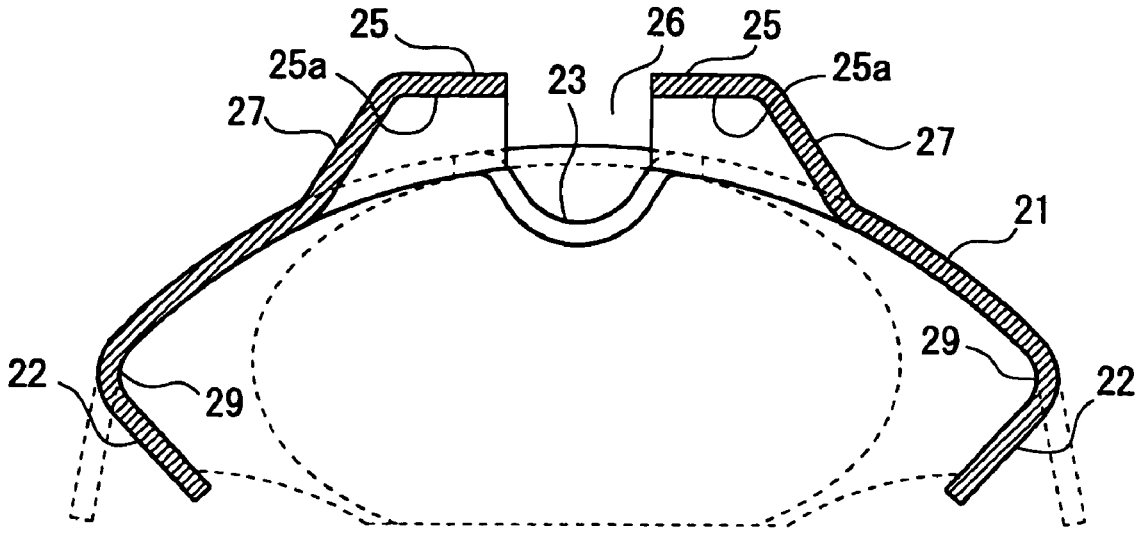
FIG. 12 is an enlarged cross sectional view along line B-B in FIG. 8.
Figure 13:
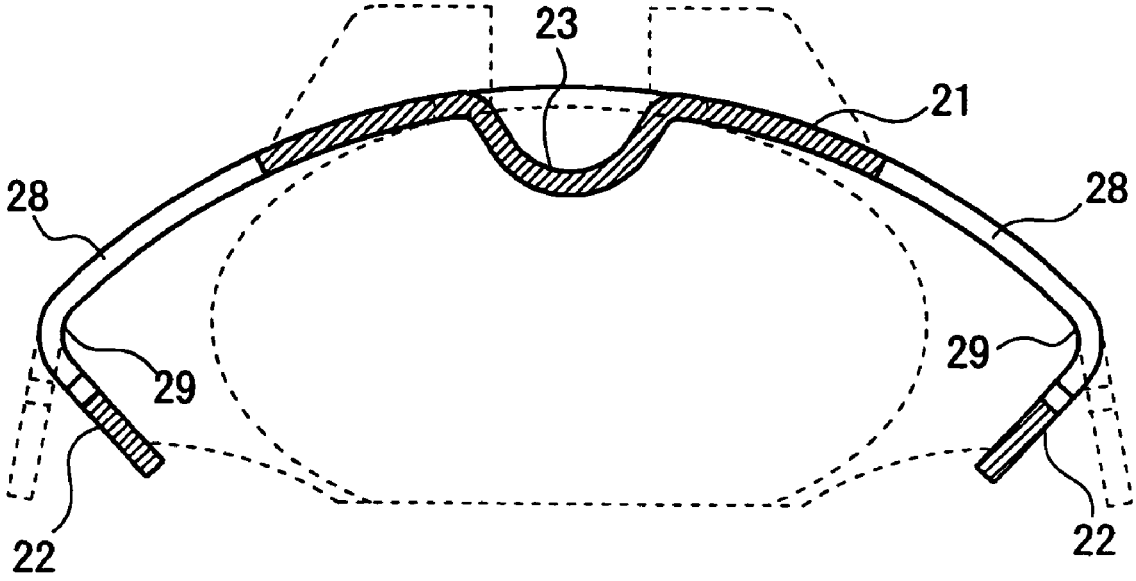
FIG. 13 is an enlarged cross sectional view along C-C in FIG. 8.

In case where the binding tool 1 is assembled, first of all, the side piece portions 22 of the base portion 2 are put into a half bent state, as shown by broken lines in FIG. 11 through FIG. 13. Under such a condition, the cam member 6 with the switching lever 4 is inserted from and set to the rear surface of the base main body 21.

Subsequently, the lap portions of the side piece portions at the inner side of the right and left support members 51, 52 are set in a mutually overlapped manner at the rear side of the base main body 21. At this time, the ring members 31, 32 attached to the right and left support members 51, 52 are guided to above the base main body 21 by using the notches 28, 28. Then, in this state, the side piece portions 22, 22 of the base portion 2 are bent to the inner side, as shown by solid lines in FIG. 11 through FIG. 15. Thereafter, the spring member 55 is set by being placed astride between the side piece portions 22, 22. Thus, the binding tool 1 as shown in FIG. 1 can be assembled.

Although in the above-mentioned embodiment, the two ring members 31, 32 constituting the rings 3 are formed in bilateral symmetry, these ring members 31, 32 need not necessarily be formed bilaterally symmetrically as long as the switching lever 4 is able to pass the opened portions of the rings. For example, the present invention can be applied to such a binding tool in which a ring takes a D shape, as viewed in front thereof.

In addition, in this embodiment, there has been shown an example in which the present invention is applied to the binding tool in which the switching lever 4 is able to pass the opened portion K of each ring 3, but in view of the technical idea or concept of the present invention, the present invention can also be applied to a binding tool in which the switching lever 4 is unable to pass the opened portion K of each ring 3.

While the invention has been described in detail with reference to preferred embodiments thereof, it will be apparent to one skilled in the art that various changes can be made, and equivalents employed, without departing from the scope of the invention. Each of the aforementioned documents, including the foreign priority document, JP 2005-356797, is incorporated by reference herein in its entirety.

What is claimed is:

1. A binding tool for documents or the like, comprising:

a base portion that is formed of a metal plate;

rings that are each mounted on said base portion so as to be selectively changed into a closed ring posture to bind documents or the like and an opened ring posture to open a part of a closed ring for insertion of the documents or the like; and a switching mechanism that is mounted on said base portion and includes a switching lever for switching said rings between said closed ring posture and said opened ring posture;

wherein said switching lever has a base end and a free end, and a cam member is provided on said base end of said switching member for adjusting the degree of opening/closing of each of said individual rings according to a rotated position of said free end of said switching lever;

said cam member has a cam main body and a pair of camshafts that protrude from opposite side surfaces of said cam main body;

said base portion is formed with a pair of bearing portions spaced apart and opposing each other with the cam member disposed therebetween, each camshaft engaging a respective one of said bearing portions, and said bearing portions are each formed of an inner surface of a curved portion where a part of said base portion is curved to a front surface side thereof;

wherein said bearing portions each has a substantially semicircular shape in cross-section, with an open side of the semicircular shape directed toward a rear surface side of said base portion;

said pair of bearing portions defining edges that oppose each other, and the base portion defining an opening disposed between said edges of the bearing portions;

said cam main body having side surfaces, each side surface being provided with a contact portion having an inner surface portion of substantially semi-circular shape in cross-section, which has a radius larger than a radius of an outer surface of said bearing portion that opposes said inner surface portion;

said inner surface portions of the contact portions being substantially in contact with the outer surfaces of the respective bearing portions when the rings are in the closed ring posture, and said contact portions preventing the camshafts from being downwardly displaced from the bearing portions during shifting from the closed ring posture to the open ring posture.

2. The binding tool for documents or the like as set forth in claim 1, wherein said base portion has a base main body and side piece portions at opposite sides thereof, which are formed by processing a metal plate in such a manner that said base main body forms a front surface of said base portion, and said side piece portions are bent in such a form as to incline toward a rear surface side of said base main body so as to form side surfaces of said base portion, and said bearing portions are formed on said base main body.

3. The binding tool for documents or the like as set forth in claim 1, wherein said bearing portions of said base main body have surfaces formed into sloped surfaces that incline downwardly toward the side piece portions, respectively, of said base portion.

4. The binding tool for documents or the like as set forth in claim 1, wherein said cam main body and said camshafts of said cam member are formed of synthetic resin in a mutually integrated manner.

5. The binding tool for documents or the like as set forth in claim 1, wherein said rings are arranged at intervals in a longitudinal direction of said base portion, and said switching mechanism is set in such a manner that when said rings are each in their opened ring posture, said switching lever is able to pass an opened portion of each ring.

6. The binding tool for documents or the like as set forth in claim 1, wherein said base portion is further formed with a groove-shaped concave portion in which a part of said switching lever is received when said rings are each in said closed ring posture.

7. The binding tool for documents or the like as set forth in claim 1, wherein each of said rings has a first ring member and a second ring member which can take a closed ring posture with their tip ends being in contact with each other and an opened ring posture with their tip ends being apart from each other;

said switching mechanism has two support members that are arranged side by side in said base portion, and are each tiltable to a side orthogonal to the longitudinal direction of said base portion;

said first ring member is supported by one of said support members, whereas said second ring member is supported by the other support member; and a spring member for urging said support members in a direction to move the tip ends of said ring members away from each other is provided between at least one of said support members and a side piece portion of said base portion.

8. The binding tool for documents or the like as set forth in claim 1, wherein the edges of the bearing portions protrude toward the opening in the base portion.

9. A binding tool for documents or the like, comprising:

a base portion that is formed of a metal plate;

rings that are each mounted on said base portion so as to be selectively changed into a closed ring posture to bind documents or the like and an opened ring posture to open a part of a closed ring for insertion of the documents or the like; and a switching mechanism that is mounted on said base portion and includes a switching lever for switching said rings between said closed ring posture and said opened ring posture;

wherein said switching lever has a base end and a free end, and a cam member is provided on said base end of said switching member for adjusting the degree of opening/ closing of each of said individual rings according to a rotated position of said free end of said switching lever;

said cam member has a cam main body and a pair of camshafts that protrude from opposite side surfaces of said cam main body;

said base portion is formed with a pair of bearing portions spaced apart and opposing each other with the cam member disposed therebetween, each camshaft engaging a respective one of said bearing portions, and said bearing portions are each formed of an inner surface of a curved portion where a part of said base portion is curved to a front surface side thereof;

wherein said bearing portions each has a substantially semicircular shape in cross-section, with an open side of the semicircular shape directed toward a rear surface side of said base portion, and said bearing portions are further provided with biasing means for always biasing the camshafts toward the bearing portions;

said pair of bearing portions defining edges that oppose each other, and the base portion defining an opening disposed between said edges of the bearing portions;

said cam main body having side surfaces, each side surface being provided with a contact portion having an inner surface portion which has a radius larger than a radius of an outer surface of said bearing portion that opposes said inner surface portion;

said contact portions preventing the camshafts from being downwardly displaced from the bearing portions during shifting from the closed ring posture to the open ring posture.

* * * * *